United States Patent [19]

Johnson, Jr. et al.

[11] 4,389,071

[45] Jun. 21, 1983

[54] ENHANCING LIQUID JET EROSION

[75] Inventors: Virgil E. Johnson, Jr., Gaithersburg; William T. Lindenmuth, Columbia, both of Md.

[73] Assignee: Hydronautics, Inc., Laurel, Md.

[21] Appl. No.: 215,829

[22] Filed: Dec. 12, 1980

[51] Int. Cl.[3] ..... E21C 37/12

[52] U.S. Cl. ..... 299/14; 134/1; 175/67; 239/101; 239/102; 299/17

[58] Field of Search ..... 299/17, 14; 175/67; 137/806; 239/101, 102; 134/1

[56] References Cited

U.S. PATENT DOCUMENTS

| | | | |
|---|---|---|---|
| 3,398,758 | 8/1968 | Unfried | 137/81.5 |
| 3,528,704 | 9/1970 | Johnson, Jr. | 299/14 |
| 3,713,699 | 1/1973 | Johnson, Jr. | 299/14 |
| 3,807,632 | 4/1974 | Johnson, Jr. | 239/104 |
| 3,897,836 | 8/1975 | Hall et al. | 239/101 X |
| 3,983,740 | 10/1976 | Danel | 73/12 |
| 4,041,984 | 8/1977 | Morel | 137/842 |
| 4,071,097 | 1/1978 | Fulop et al. | 175/56 |
| 4,185,706 | 1/1980 | Baker et al. | 175/340 |

OTHER PUBLICATIONS

Orderly Structure in Jet Turbulence, by S. C. Crow and F. H. Champagne, pp. 547-598, J. Fluid Mech., (1971), vol. 48, part 3.

Experimental Study of a Jet-Driven Helmholtz Oscillator, Thomas Morel, Journal of Fluids Engineering, Sep. 1979, vol. 101, pp. 383-390.

*Primary Examiner*—Ernest R. Purser

*Attorney, Agent, or Firm*—Finnegan, Henderson, Farabow, Garrett & Dunner

[57] ABSTRACT

Process and apparatus for enhancing the erosive intensity of a high velocity liquid jet when the jet is impacted against a surface for cutting, cleaning, drilling or otherwise acting on the surface. A preferred method comprises the steps of forming a high velocity liquid jet, oscillating the velocity of the jet at a preferred Strouhal number, and impinging the pulsed jet against a solid surface to be eroded. Typically the liquid jet is pulsed by oscillating the velocity of the jet mechanically or by hydrodynamic and acoustic interactions. The invention may be applied to enhance cavitation erosion in a cavitating liquid jet, or to modulate the velocity of a liquid jet exiting in a gas, causing it to form into discrete slugs, thereby producing an intermittent percussive effect.

17 Claims, 28 Drawing Figures

Fig. 3a
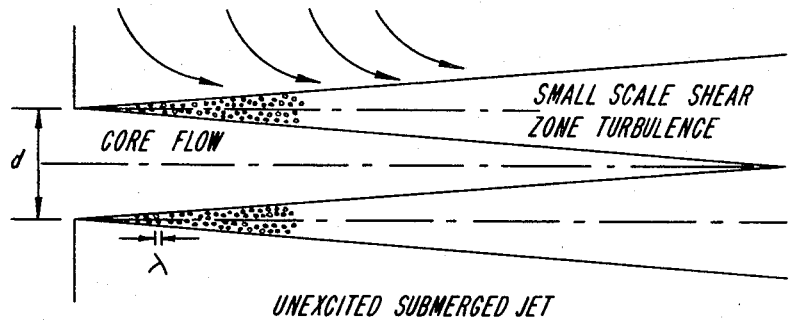
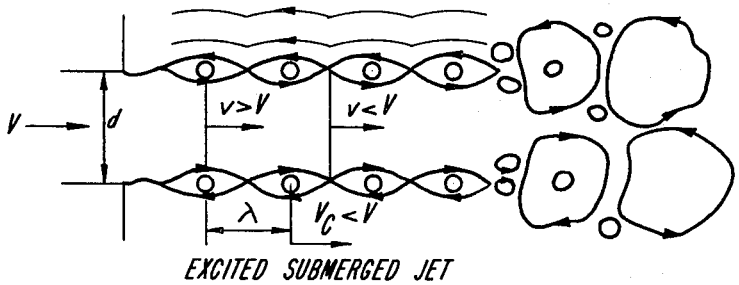
Fig. 3b
Fig. 4a
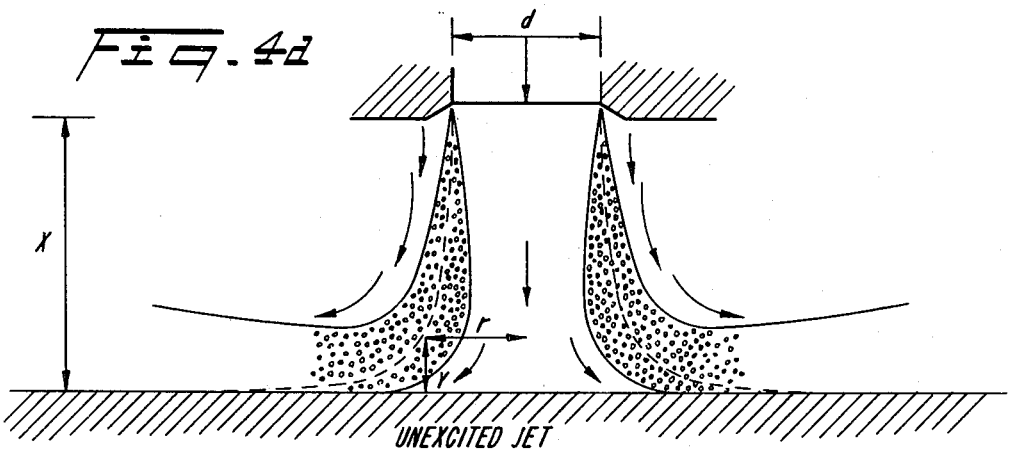
Fig. 4b
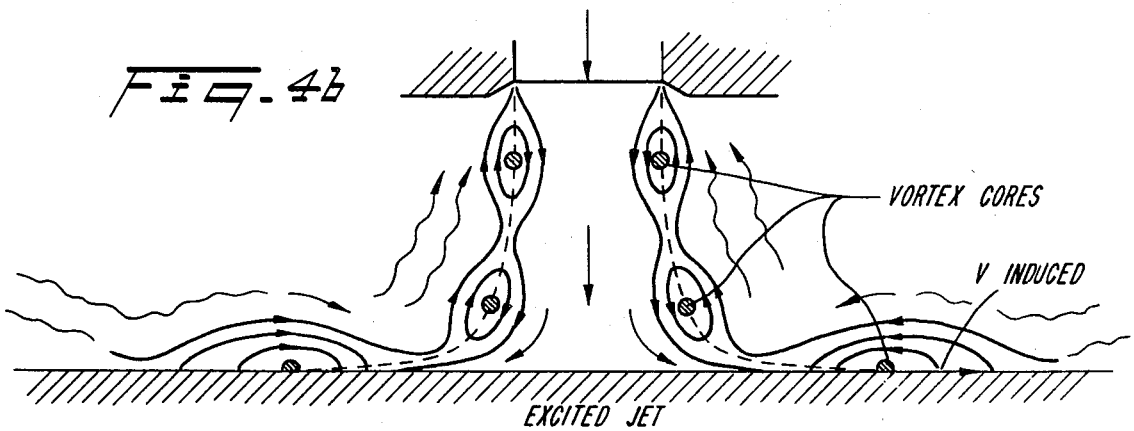

Fig. 5
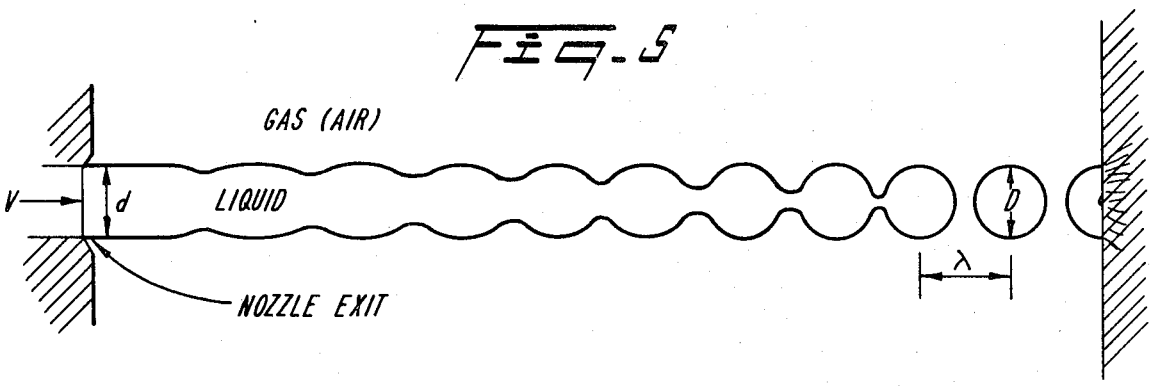
Fig. 6a
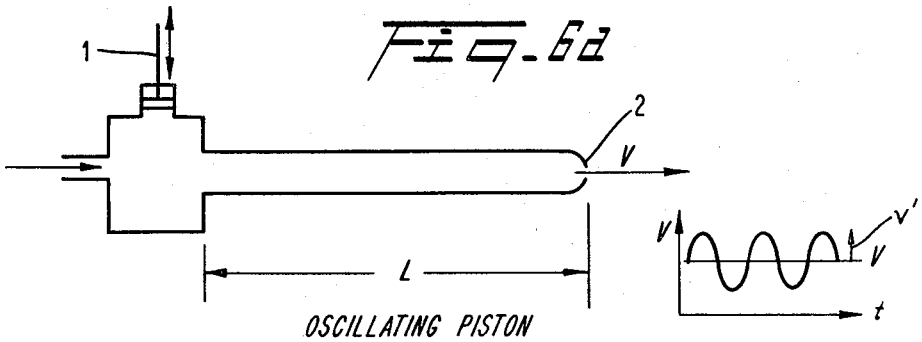
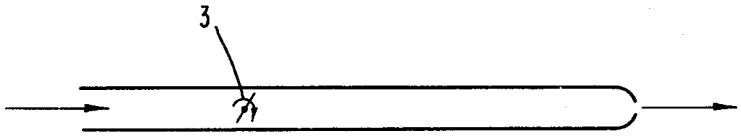
Fig. 6b
Fig. 6c
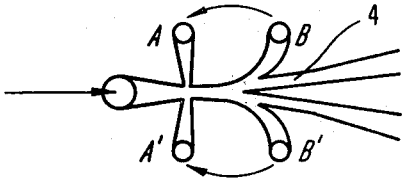
FLUID OSCILLATOR VALVE
Fig. 6d
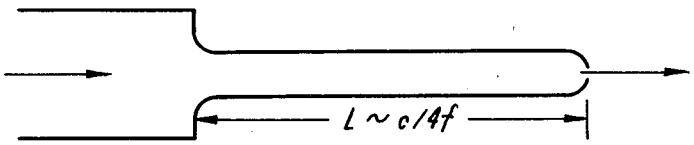
ORGAN PIPE ACOUSTIC OSCILLATOR
Fig. 6e
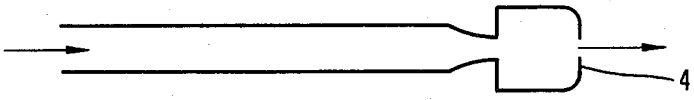
HELMHOLTZ ACOUSTIC OSCILLATOR Fig. 11a
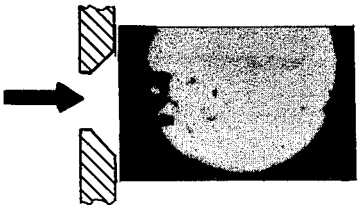
NO EXCITATION
Fig. 11b
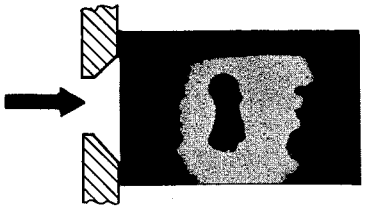
EXCITATION (f= 5,156 Hz)
Fig. 11c
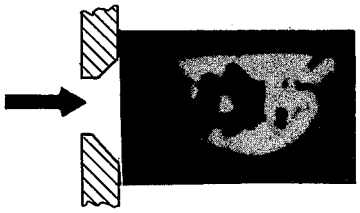
EXCITATION (f=10,310 Hz)
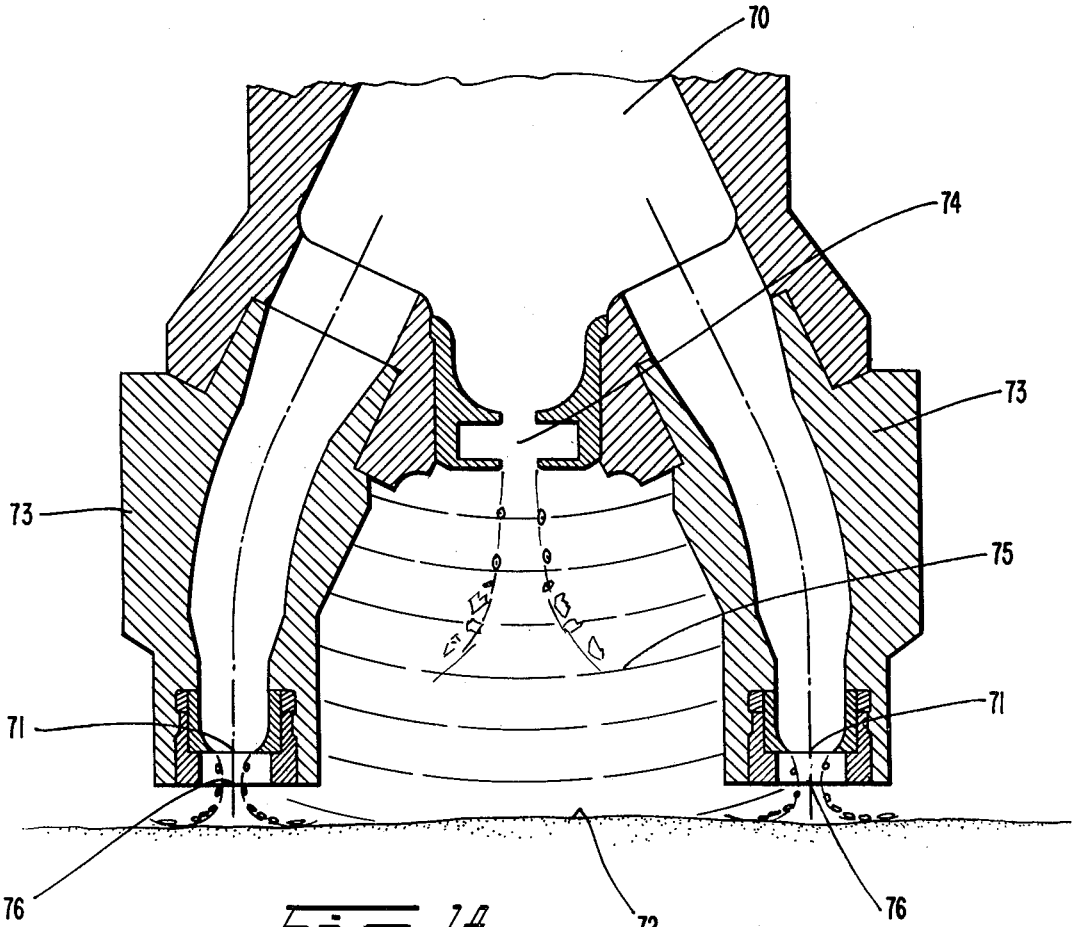
Fig. 18

ENHANCING LIQUID JET EROSION

BACKGROUND OF THE INVENTION

The invention relates to a process and apparatus for pulsing, i.e., oscillating, a high velocity liquid jet at particular frequencies so as to enhance the erosive intensity of the jet when the jet is impacted against a surface to be eroded. Eroding conditions include cleaning, cutting, drilling or otherwise acting on the surface. The method may be particularly applied to enhance cavitation in a cavitating liquid jet such as described in U.S. Pat. Nos. 3,528,704, 3,713,699 and 3,897,632 and U.S. Pat. No. 4,262,757. It may also be used to modulate the velocity (at particularly preferred frequencies) of a simple high velocity liquid jet exiting in a gas in such a way as to cause the jet to become a series of water slugs or drops which upon impact produce water hammer blows to the surface to be eroded.

In U.S. Pat. Nos. 3,713,699 and 3,807,632, cavitation, that is, the formation of vapor cavities or bubbles in a high velocity liquid jet in the shear zone between a high velocity jet and a relatively low velocity fluid, which surrounds the jet when the jet is either naturally or artificially submerged, is described as an important source of the vapor cavities in the jet. Furthermore, the patents disclose the concept of pulsing the jet.

Experiments have been reported using air jets discharging into a gaseous atmosphere. See, S. C. Crow and F. H. Champagne, "Orderly Structure in Jet Turbulence", *Journal of Fluid Mechanics,* Vol. 48, Part 3, August 1971. These experiments related to understanding the production of jet aircraft noise, and revealed that when the jet exit velocity, V, is oscillated about its mean value with an amplitude equal to only a few percent of the mean value, the structure of the jet altered dramatically when the frequency of oscillation (f) was in the range of 0.2 to 1.2 times the ratio of the jet velocity, V, to the jet diameter, D. That is, the jet structure change occurred for a range of Strouhal numbers, S, defined as (fD/V), between 0.2 and 1.2. The most dramatic change in the jet structure occurred for S=0.3 and 0.6. The shear zone surrounding the air jet apparently changes from a zone of largely uncorrelated fine scale eddies to a series of discrete vortices convecting down the periphery of the jet at a speed approximately equal to 0.7 of the jet exit speed. These vortices therefore have a spacing of approximately the jet diameter and appear to an observer stationary with respect to the nozzle exit as waves having a wavelength of the same order as the vortex spacing. This well-defined structure of the air jet is observed to break up after several jet diameters into a turbulent flow.

U.S. Pat. No. 3,398,758 discloses an air jet driven pure fluid oscillator as a means of providing a pulsating jet as a carrier wave for a communication device.

In "Experimental Study of a Jet Driven Helmholtz Oscillator," *ASME Journal of Fluids Engineering,* Vol. 101, September 1979, and U.S. Pat. No. 4,041,984, T. Morel presents extensive information of air jet driven Helmholtz oscillators and indicates that he was not able to achieve satisfactory operation for jet speed to sound speed ratios (Mach number) greater than 0.1.

U.S. Pat. No. 4,071,097 describes an underwater supersonic drilling device for establishing ultrasonic waves tuned to the natural frequency of rock strata. This device differs from the oscillators described by Mr. Morel or in U.S. Pat. No. 3,398,758, in that the resonance chamber is fed by an orifice which has a disturbing element placed in the orifice so as to partially obstruct the orifice.

U.S. Pat. No. 3,983,740 describes a method and apparatus for producing a fast succession of identical and well-defined liquid drops which are impacted against a solid boundary in order to erode it. The ultrasonic excitation of the liquid jet is accomplished with a magnetostrictive ultrasonic generator having a wavelength approximately equal to the jet diameter.

SUMMARY OF THE INVENTION

The present invention provides a method of eroding a solid surface with a high velocity liquid jet, comprising the steps of forming a high velocity liquid jet, oscillating the velocity of the jet at a Strouhal number within the range of from about 0.2 to about 1.2, and impinging the pulsed jet against the solid surface. Typically the liquid jet is pulsed by oscillating the velocity of the jet mechanically, or by hydrodynamic and acoustic interactions.

Objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

As embodied herein, the invention further provides a method as described above, wherein the liquid jet is pulsed by situating it within a chamber submerged in a liquid, said chamber containing a further liquid jet which is pulsed at a Strouhal number within the range of from about 0.2 to about 1.2, whereby the oscillation of the further liquid jet induces oscillation of the liquid jet.

In a further embodiment the liquid jet is formed by directing a liquid through an orifice, and the jet is pulsed by oscillating the pressure of the liquid prior to directing it through the orifice.

In another embodiment the liquid is directed through a first orifice and the jet is formed by directing the liquid through a second orifice, and the jet is pulsed by oscillating the pressure of the liquid after it exits the first orifice through hydrodynamic and acoustic interactions. Typically a Helmholtz chamber is formed between the first and second orifices, wherein the pressure of the liquid is oscillated within the Helmholtz oscillator, and a portion of the energy of the high velocity liquid is utilized to pulse the liquid.

As embodied herein, the invention further provides a method as broadly described above, wherein the pulsed, high velocity liquid jet is surrounded by a gas and forms into discrete, spaced apart slugs, thereby producing an intermittent percussive effect. Typically, the liquid comprises water and the gas comprises air, and the velocity of the jet is oscillated at a Strouhal number within the range of from about 0.66 to about 0.85, and the distance between the solid surface and the orifice from which the jet exits is determined by the following equation:

$$X=D/2S\cdot V/v'$$

where X is the distance, D is the orifice diameter, S is the Strouhal number, V is the mean jet velocity and v' is the oscillation amplitude about the mean velocity.

As embodied herein, the invention further provides a method as broadly described above, wherein the pulsed high velocity liquid jet is surrounded by a liquid and forms into discrete, spaced apart vortices, and wherein vapor cavities of the liquid are formed in the vortices and the vortices spread over the solid surface at a distance from the orifice where said vapor cavities collapse, thereby producing cavitation erosion. Typically, the velocity of the pulsed liquid jet is at least about Mach 0.1, and the velocity of the jet is oscillated at a Strouhal number within the range of from about 0.3 to about 0.45, or from about 0.6 to about 0.9, and the distance between the solid surface and the orifice from which the jet exits is no greater than about 6 times the diameter of the jet, for cavitation numbers greater than about 0.2.

As embodied herein, the invention further provides a method as broadly described above, wherein the pulsed, high velocity liquid jet forms into discrete, spaced apart vortices, and wherein vapor cavities of the liquid are formed in the vortices and the vortices spread over the solid surface at a distance from the orifice where said vapor cavities collapse, thereby producing cavitation erosion, the formation of vapor cavities being assisted by a center body located in the outlet of the jet-forming nozzle to form an annular orifice for the nozzle.

Broadly, the invention further comprises apparatus for producing a pulsed liquid jet for eroding a solid surface, comprising means for forming a high velocity liquid jet, and means for oscillating the velocity of the jet at a Strouhal number within the range of from about 0.2 to about 1.2. Typically, the means for oscillating the velocity of the jet comprises a mechanical oscillator, and the mechanical oscillator typically comprises an oscillating piston or an oscillating mechanical valve.

Alternately, the means for oscillating the velocity of the jet may comprise a hydro-acoustic oscillator. Typically, the oscillator comprises an organ-pipe oscillator or a Helmholtz oscillator.

Alternately, the means for oscillating the velocity of the jet comprises a fluid oscillator valve.

As embodied herein, the invention further provides apparatus for producing a pulsed liquid jet for eroding a solid surface, comprising a liquid jet nozzle for discharging a liquid jet, said liquid jet nozzle having a housing for receiving a liquid, said housing having an interior chamber contracting to a narrower outlet orifice, and a Helmholtz oscillator chamber situated in tandem with the liquid jet nozzle for oscillating the liquid jet at a Strouhal number within the range of from about 0.2 to about 1.2, said outlet orifice of the cavitating liquid jet nozzle comprising the inlet to the Helmholtz oscillator chamber and said Helmholtz oscillator chamber having a discharge orifice for discharging the pulsed liquid jet. Typically, a portion of the volume of the Helmholtz oscillator chamber is located in an annular space surrounding said outlet orifice.

As further embodied herein, the invention comprises apparatus for producing a pulsed liquid jet for eroding a solid surface, comprising a liquid jet nozzle for discharging a liquid jet, said liquid jet nozzle having a housing for receiving a liquid, said housing have an interior chamber contracting to a narrower outlet orifice, a Helmholtz oscillator chamber situated in tandem with the liquid jet nozzle for oscillating the liquid jet at a Strouhal number within the range of from about 0.2 to 1.2, said outlet orifice of the liquid jet nozzle comprising the inlet to the Helmholtz oscillator chamber and said Helmholtz oscillator chamber having a discharge orifice, and a diffusion chamber situated in tandem with the Helmholtz oscillator chamber, said discharge orifice of the Helmholtz oscillator chamber comprising the inlet to the diffuser chamber, said diffusion chamber contracting to a narrower jet-forming orifice and smoothing the inflow to the jet-forming orifice.

Broadly, the invention further comprises apparatus for producing a pulsed liquid jet for eroding a solid surface, comprising hydro-acoustic nozzle means for oscillating the velocity of a first liquid jet, said first liquid jet being discharged within a chamber, at least one cavitating liquid jet nozzle having a housing for receiving a liquid, said housing having an interior chamber contracting to a narrower discharge orifice for discharging a second liquid jet within said chamber such that the velocity of said second liquid jet is pulsed by the action of the pulsed first liquid jet, thereby increasing its erosive intensity. Typically, the apparatus may further comprise a roller bit for drilling a hole in the solid surface, at least two extension arms for supplying drilling fluid to the hole, and at least two cavitating liquid jets situated at the extremities of said extension arms, and wherein said chamber comprises the hole filled with drilling fluid.

BRIEF DESCRIPTION OF THE DRAWINGS

FIGS. 3*a* and 3*b* show a comparison of flow patterns for excited and unexcited submerged jets;

FIG. 4*a* shows an unexcited submerged liquid cavitating jet impinging on a solid boundary, and FIG. 4*b* shows an excited submerged liquid cavitating jet impinging on a solid boundary;

FIG. 5 shows a percussive liquid jet exiting into a gas and forming a series of slugs or drops which impinge on a solid boundary;

FIG. 6 shows five alternate general concepts for pulsing fluid jets in accordance with the present invention;

FIGS. 11*a*, 11*b* and 11*c* illustrate a comparison of the cavitation patterns observed in the test rig shown in FIG. 10 with and without excitation of a submerged liquid jet;

FIG. 18 is a schematic drawing showing the extended arms, cavitating jets, and pulser nozzle used in a two or three cone roller bit for use in drilling in accordance with a further embodiment of the invention.

DESCRIPTION OF THE PREFERRED EMBODIMENTS

Reference will now be made in detail to the presently preferred embodiments of the invention, examples of which are illustrated in the accompanying drawings.

I have found that if a cavitating liquid jet, as opposed to an air jet, is excited so as to structure itself into discrete vortices, such a liquid jet will cavitate more violently and thus cause greater erosion to a boundary placed near the jet exit at an optimum stand-off distance. I have determined that a liquid jet excited at the proper Strouhal number will cavitate much more readily than would be predicted from the simple increase in velocity during a peak velocity amplitude accompanying an excitation.

For ease in understanding the invention, the parameters referred to as the cavitation number, $\sigma$, and the incipient cavitation number, $\sigma_i$, will be explained briefly.

Since the invention is concerned with high velocity liquid jets, the characteristic pressure and velocity selected for the definitions are:

$P_o$=the pressure in the supply pipe for a high speed jet nozzle.

$P_a$=the pressure to which the jet is exhausted; that is, the ambient pressure surrounding the jet.

$P_v$=the vapor pressure of the liquid at the liquid temperature.

$\rho$=the mass density of the liquid.

The cavitation number $\sigma$ may then be defined as:

$$\sigma = \frac{P_a - P_v}{\frac{1}{2}\rho V^2} \tag{1}$$

The value, $\frac{1}{2}\rho V^2$, will be equal to a constant times $(P_o - P_a)$, or denoting $(P_o - P_a)$ as $\Delta P$, a constant times $\Delta P$. This constant depends on the nozzle configuration, and in most cases may be assumed to be equal to one. Furthermore, for high pressure jets, $P_v$ is much less than $P_o$ and in many cases the cavitation number for jets may be approximated by $\sigma = P_a/\Delta P$.

The particular value of $\sigma$ when cavitation first starts, or is incipient, is denoted as $\sigma_i$. That is, $$\sigma_i = \left(\frac{P_o - P_v}{\frac{1}{2}\rho V^2}\right) \text{ at inception} \tag{2}$$

For the purpose of this explanation, it may be assumed that the necessary nuclei for cavitation to occur, when local pressures reach the vapor pressure, are present. Cavitation will be incipient when the minimum pressure at the location of inception first reaches the vapor pressure. Thus $$\sigma_i = \left(\frac{P_o - P_{min}}{\frac{1}{2}\rho V^2}\right) \tag{3}$$

where $P_{min}$ is the minimum pressure at the location of inception.

Figure 1:
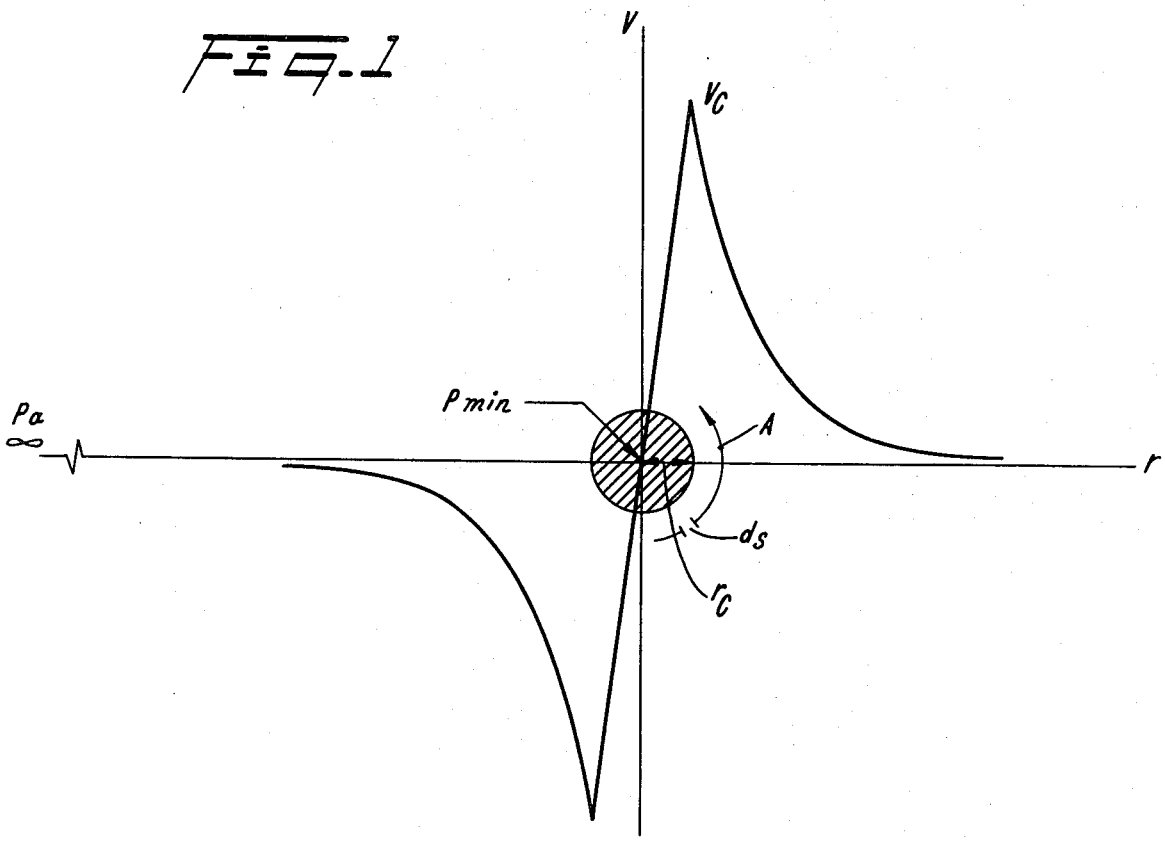
FIG. 1 shows the velocity distribution in a Rankine line vortex.

FIG. 1 shows the velocity distribution in a line vortex rotating in the direction shown by arrow A having a forced (rotational) core radius denoted as $r_c$ and a velocity at $r_c$ equal to $V_c$. Such a vortex is called a Rankine vortex and is a reasonable approximation of vortices which exist in real fluids having viscosity. For such a single line vortex, the value of the pressure drop from the ambient pressure, $P_a$, to the minimum pressure $P_{min}$ (as shown in FIG. 1) which exists at the center of the core is $$\frac{P_a - P_{min}}{\frac{1}{2}\rho V^2} = \frac{\Gamma^2}{2\pi^2 V^2 r_c^2} = \sigma_i \text{ (Vortex center)} \tag{4}$$

where $\Gamma$ is the circulation around the vortex. That is, $$\Gamma = \phi V.dS \tag{5}$$

Figure 2:
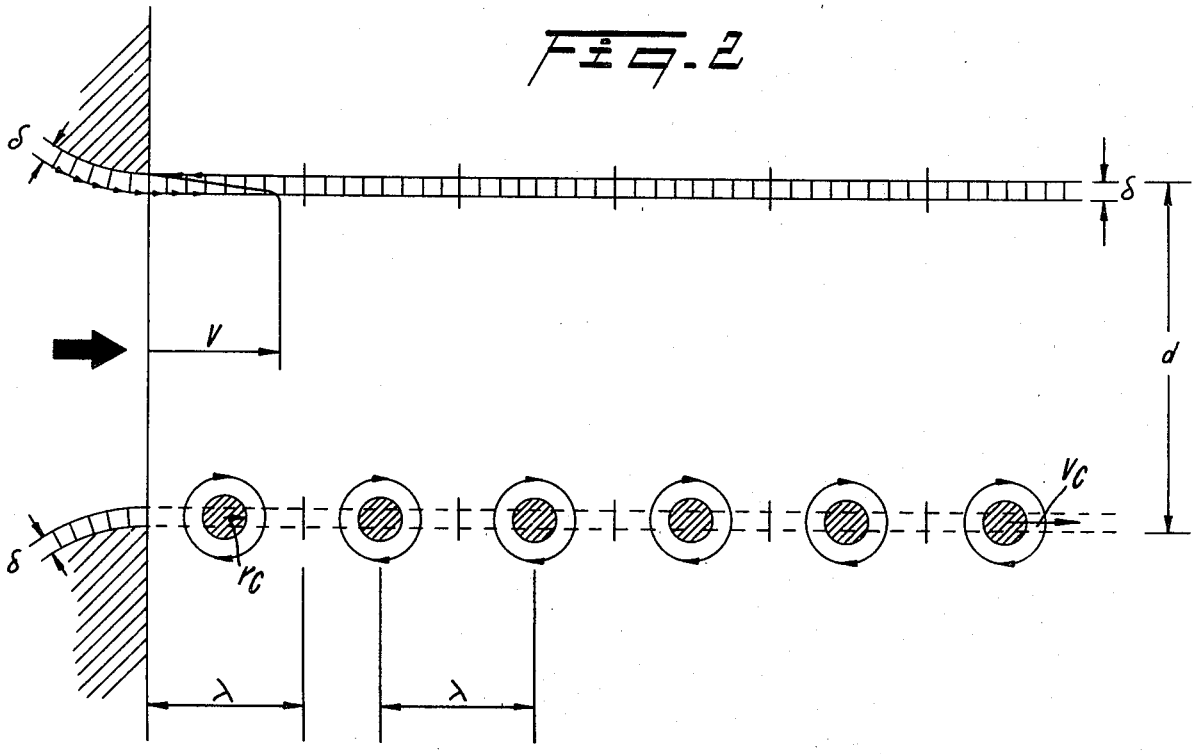
FIG. 2 shows the core size of ideal ring vortices formed in the shear zone of a submerged jet.

FIG. 2 illustrates schematically how the core size of ideal ring vortices formed in the shear zone of a submerged jet is assumed to be established. Flow leaves the nozzle exit, of diameter D, with a uniform velocity, V, over the nozzle exit plane except for the boundary layer region, which is of characteristic thickness, $\delta$. The ideal shear zone, assuming no mixing with an outer fluid, is shown in the upper portion of the nozzle. In a real flow, exterior fluid is entrained and Rankine vortices form, with the rotational boundary fluid as the core. The lower portion shows how the core of distinct vortices, having a spacing denoted as $\lambda$, have a core made up of fluid that has an area equal to $\lambda\delta$. If the core of these distinct vortices is assumed to be circular then $$r_c^2 = \frac{\lambda\delta}{\pi} \tag{6}$$

The circulation of each vortex is obviously $\lambda V$. Thus, from equation (5)

$$\sigma_i\text{, (Vortex Center)} = \frac{V^2\lambda^2}{V^2 2\pi^2\left(\frac{\lambda\delta}{\pi}\right)} = \frac{\lambda}{2\pi\delta} \tag{7}$$

Since $\sigma_i$ is desired to be as high as possible in order to cause increased cavitation and erosion, it is preferable for a given nozzle liquid and speed ($\delta$being fixed), to have $\lambda$ as large as possible. As shown in FIG. 3, for unexcited jets, the shear zone has many small vortices ($\lambda$ is small and of order $\delta$,) whereas I have found that, for an excited jet, $\lambda$ is of the order of the jet diameter, d.

The preceding analysis is not exact because of the various simplifying assumptions made, (for example, the detailed pressure distribution in a ring vortex system is more complex) but the important result shown is that, qualitatively, $(\sigma_i)$ excited is much greater than $(\sigma_i)$ unexcited.

It is important to note the above-described increase in cavitation inception for a liquid jet excited at a preferred Strouhal number is entirely different from the increase that might obviously be assumed based on a quasi steady state analysis. That is, $$(\sigma_i)\ \text{pulsed} = \sigma_i\ \text{steady}\ (1+V^1/V)^2 \tag{8}$$

where v' is the magnitude of the excitation amplitude that is, maximum velocity=V+v'. Very small amplitudes of excitation (v'/V=0.02) are required to achieve jet structuring and thus substantial increases in $\sigma_i$ may be achieved for structured jets. Such substantial increases in $\sigma_i$ would not be suggested by equation (8).

The general effect described in the foregoing analysis is independent of the stand-off distance, X, i.e., the distance from the nozzle end to the fixed boundary to be eroded by a cavitating jet. In fact, the analysis neglected the boundary influence. I have determined that significant additional new cavitation effects occur at relatively short stand-off distances, for example X<6d. These effects are illustrated in FIGS. 4*a* and 4*b*. The upper figure, 4*a*, shows an unexcited submerged liquid jet (with small scale random vortices) impinging on a solid boundary only a few diameters (d) away. The lower figure, 4*b*, illustrates a submerged liquid jet excited at a preferred Strouhal number, with discrete vortices impinging on a solid boundary.

The dashed lines in FIGS. 4*a* and 4*b* having coordinates (r,y) represent the jet boundary that would exist if there were no mixing. It is assumed in FIG. 4*b* that the vortex centers lie on this path. For values of r/d≦1, this path can be obtained from the continuity equation (assuming the flow in this outer region is entirely radial). The approximate equation for this path is, $$\frac{y}{d} = \tfrac{1}{8}\frac{d}{r}\ \text{or}\ \frac{\gamma}{d} = \tfrac{1}{8}\frac{d}{y} \tag{9}$$

Thus, as the vortex rings approach the boundary (d/y increases and thus r/d increases), the ring size increases. It is fundamental in hydrodynamics that such a "stretching" of a vortex will result in a decrease in core size. In fact, if it is assumed that the core fluid in a ring of radius $r_1$ redistributes to fill the same volume when the ring stretches to a new radius $r_2$, the ratio of core sizes will be given by the following equation $$\left(\frac{r_{c,2}}{r_{c,1}}\right)^2 = \frac{r_1}{r_2} \tag{10}$$

Thus, from equation (4)

$$\frac{(\sigma_i)_2}{(\sigma_i)_1} = \frac{r_2}{r_1} \tag{11}$$

Assuming that $(\sigma_i)_1$, represents the value of $\sigma_i$ in a ring near the nozzle exit and thus away from the boundary, with $r_1$=d/2, the value of $(\sigma_i)_2$ for a ring closer to the boundary, as given by equation (9) becomes $$\frac{(\sigma_i)_2}{(\sigma_i)_1} = \tfrac{1}{4}\frac{d}{y} \tag{11a}$$

$$\left(\text{For}\ \frac{r}{d} \geqq 1,\ \text{thus}\ \frac{d}{y} \geqq 8\right)$$

Thus, in the absence of viscous effects (core size growth due to viscosity and circulation decrease caused by wall friction), cavitation should first occur in the vortices as they spread over the boundary rather than at their birth near the nozzle. I have found that these effects tend to cause the actual core minimum pressure to occur somewhere between the exit orifice and r/d≃2. The exact location must be determined by experiment. However, this analysis illustrates that the presence of a boundary should further enhance the cavitation in an excited jet with discrete vortices. This effect has been confirmed by experiment.

Possibly a more important influence of a boundary on the cavitation characteristics of an excited jet with discrete vortices is the reduction in pressure on the boundary that should result as a vortex spreads radially over it. This effect is also shown in FIG. 4*b*.

In the absence of viscosity, the velocity field near the vortex of strength $\Gamma$ in FIG. 4*b* varies inversely with distance from the vortex. The actual induced velocity at the boundary may be approximately determined by placing an image of the vortex within the boundary and is, for a vortex circulation of $V\lambda$, $$V_{induced} = \frac{8\pi V\lambda}{d}\ \frac{r}{d} \tag{12}$$

Thus the total instantaneous velocity, $V_t$, on the wall beneath a vortex as it sweeps over the boundary is $$V_t = V + \frac{1}{\pi}\ \frac{V\lambda}{d}\ \frac{d}{y} \tag{13}$$

and the pressure at this point, from Bernouilli's equation, is given by $$\frac{P_a - P_{min}}{\frac{1}{2}\rho V^2}\ \sigma_{i\ boundary} = \left(1 + \frac{1}{\pi}\ \frac{\lambda}{d}\ \frac{d}{y}\right)^2 \tag{14}$$

Substitution of equation (9) into equation (14) results in $$\sigma_{i\ boundary} = \left(1 + \frac{8}{\pi}\ \frac{\lambda}{d}\ \frac{r}{d}\right)^2,\ \text{for}\ \frac{r}{d} > 1 \tag{15}$$

Equation (15) reveals that very high values of $\sigma_i$ boundary will obtain even for r/d=1; that is, $\sigma_{i\ boundary} \cong 12$ (for $\lambda/d \cong 1$).

Viscous effects will modify the result given in equation (15). Obviously, friction and vortex breakdown will begin to have large influence even for r/d<1. But equation (15) indicates that cavitation inception for short stand off distances where the discrete vortices in an excited jet have not yet broken down, will have high values on the wall beneath the vortex as it spreads. These cavities which occur on the wall, rather than in the vortex cores, should be most damaging to the boundary material because they are immediately collapsed by the higher than ambient pressures which are induced by the vortex after it passes and before the following vortex was arrived.

Thus, I have determined that the performance of a cavitating jet can be significantly improved if the jet velocity is oscillated, that is, excited (pulsed), at preferred Strouhal numbers so as to cause the jet to structure into discrete vortices, and that there are at least three reasons for this. I have found that liquid jets will structure into such discrete vortices for the range of excitation Strouhal numbers of from about 0.2 to about 1.2, and that for configurations tested in water using a cavitating jet nozzle constructed in accordance with the teachings of allowed U.S. patent application Ser. No. 931,244, the optimum Strouhal numbers are about 0.45 and about 0.90.

The preferred Strouhal number (based on nozzle diameter, $S=fD_1/V$) for which a jet structures into discrete vortices in an optimum way depends on the nozzle contour. I have found that for preferred conventional cavitating jet nozzles which cause the final jet to contract to a diameter approximately 75% of the orifice diameter, that the preferred first mode Strouhal number, based on diameter, is 0.45. Nozzles that produce less contraction will have preferred Strouhal numbers less than 0.45. In general, if the preferred Strouhal number is based on jet diameter rather than orifice diameter, its value will be nearly independent of nozzle shape. Thus, the preferred Strouhal numbers, based on jet diameter $S_d=fd/V$, as determined from my experiments with forced jets in water, will be approximately 0.35 and higher mode multiples of this value.

It is important to recognize that the enhancement of erosion caused by pulsing (exciting) the jet at a preferred frequency is not the known effect to be expected from pulsing a jet at any frequency, whereby increased erosion during the peak velocity is greater than the loss in erosion during the reduced velocity. Furthermore, this known mechanism requires large amplitudes of oscillation to gain relatively small increases in net erosion for a given power input. The method and process of the present invention require a definite frequency of oscillation (excitation) and the magnitude need only be a few percent of the mean velocity.

In addition to cavitation erosion, which relies on submerged jets, another form of high pressure jet erosion utilizes intermittent or percussive jets, which involve high-pressure liquid jets of diameter, d, discharged into a gas such as the ambient atmosphere. FIG. 5 shows a liquid jet exiting into a gas, with the jet impinging on a solid boundary. If the exit velocity is oscillated, the jet will break into a series of slugs or drops having a final spacing, λ, between drops determined by $$\lambda = V/f \tag{16}$$

where V is the mean jet speed and f is the frequency of oscillation.

If the final drops are assumed to be spherical, their diameter, D, must be such as to contain the volume $\pi\lambda d^2/4$. Thus, $$\left(\frac{D}{d}\right)^3 = \frac{3}{2}\,\frac{V}{fd} \text{ or } \frac{3}{2}\,S_d^{-1} \tag{17}$$

where $S_d$ is the Strouhal number based on jet diameter, d.

These slugs or drops in such percussive jets produce impact or waterhammer pressure ($\rho cV$), where c is the sound speed in the liquid) which is much higher than the pressure generated by a continuous jet ($\frac{1}{2}\rho V^2$).

It is known that such percussive jets tend to be more erosive than continuous jets, and that their intensity of erosion increases with the modulation frequency. I have determined that improved erosion may be obtained if percussive jets are oscillated at a frequency within the range of Strouhal numbers S=about 0.02 to about 1.2 which, by coincidence, is the same range as that required to structure a submerged jet. The mechanisms which lead to this optimum range are entirely different, however.

In percussive jets the impact pressure will be cushioned or relieved if the water from one slug is not given adequate time to escape prior to the arrival of the following slug or drop. This time is of the order of magnitude of the total time (T) of crushing of one slug, and can be approximated by:

$$T \approx D/V \tag{18}$$

The frequency of impact must therefore be smaller than:

$$\text{Thus,}\quad \left.\begin{aligned} f &\leqq \frac{V}{D} \\ S_d &= \frac{fd}{V} \leqq \frac{d}{D} \end{aligned}\right\} \tag{19}$$

which, by taking equation (17) into account, can be written:

$$S_d \leqq 0.85. \tag{20}$$

Once it is formed, a drop or slug cannot keep its integrity for a long period of time. The equilibrium between surface tension forces and aerodynamic drop forces is preserved as long as the Weber number:

$$W_e = \frac{\rho V^2 D}{\phi} \tag{21}$$

(where $\phi$ is the surface tension)

is not bigger than a limiting value ($\approx 50$). This limits the maximum stable drop diameter to a fraction of microns. However, the distance needed for rupture is several times D, so that if the target is close to the region where the drops are first formed rupture can be avoided. In addition, drag forces can be reduced by trying to produce slugs with diameter, D, close to the jet diameter, d. This can be written:

$$\frac{D}{d} = \left(\frac{3}{2S_d}\right)^{\frac{1}{3}} \leqq 1, \text{ or } S_d \geqq 0.66. \tag{22}$$

The optimum region is a narrow one: $0.66 \leqq S_d \leqq 0.85$. Obviously this range is intended for guidance only. The actual optimum range is probably broader and centered around 0.75, say 0.2 to 1.2.

This finding of an optimum Strouhal number for percussive jets is significant, because it means that nozzle systems developed to produce structured ring vortex cavitating jets in submerged or artificially submerged operation should also be near optimum nozzle systems for percussive operation when not submerged or artificially submerged.

There will likely also be an optimum stand-off distance for percussive jets which will be dependent on the Strouhal number and amplitude of the jet excitation, v'. The following analysis gives an approximation to the required relationships.

If λ is the wavelength of the modulation frequency, a crest will overtake a trough after a time T:

$$T = \frac{\lambda}{2 \cdot v'} \tag{23}$$

The required distance X to accomplish this bunching is then $$X = T \cdot V = \frac{\lambda}{2} \cdot \frac{V}{v'} \tag{24}$$

Or, $$\frac{X}{d} = \frac{1}{2S}\left(\frac{V}{v'}\right) \tag{25}$$

If it is assumed that in a practical device (V/v') is between 0.02 and 0.10 and the optimum Strouhal number is between 0.2 and 1.2, such a device could be designed for any range of stand-offs between $x/d=4$ and 83. This range is of course dependent on the range (v'/V) selected.

It should be noted that the excited submerged cavitating vortex jet has its best operation when only a few diameters from the boundary. However, at very low cavitation numbers, good performance extends out to say 20 diameters or more.

The foregoing discussion teaches how high pressure jets, particularly submerged cavitating jets, can be made more effective in eroding a boundary material if the jet velocity is oscillated in the Strouhal number range of about 0.2 to 1.2. Within this range there are two preferred values, about 0.45 and about 0.90, which I have found experimentally for nozzle contours that cause large jet contraction. For nozzle contours causing little or no contraction, the preferred values are about 0.35 and 0.70. The excitation amplitude need be only a few percent of the mean jet velocity. Higher amplitudes however will increase the erosion effectiveness. Any device capable of producing the excitation may be used. Examples of such devices are illustrated in FIGS. (*6a–6e*).

FIG. *6a* illustrates the most straightforward type of mechanical pulsing, that is, piston displacement. A piston 1 is oscillated upstream of the jet orifice 2 in a chamber such that the impedance in the direction of the main flow source is high and in the direction of the jet nozzle the impedance is low. An obvius amplification of the pressure oscillation at the nozzle can be achieved by establishing a standing wave reasonance in the system.

FIG. *6b* illustrates another mechanical pulsing concept involving oscillatory throttling of the flow supply to the nozzle. This concept might utilize a rotating valve 3. Proper sizing of the supply geometry may be used to set up resonance and thus amplify the magnitude of the oscillation of the jet flow.

FIG. *6c* illustrates another type of valve oscillator which does not require moving parts. The system utilizes fluid amplifier techniques such as the one illustrated to accomplish the oscillation. This device oscillates the flow back and forth about a splitter plate 4 as follows: flow on one side causes a positive pressure to be fed back through the return path (B' to A' or B to A); this positive pressure applied at the jet root forces the jet to the alternate path which then sends back a positive signal to force the jet back again to repeat the process. This type of oscillator is ideal for dividing and oscillating the flow between two nozzles and thus achieving an on-off type of oscillation.

FIG. *6d* illustrates the simplest possible acoustic oscillator pulsing device: an organ-pipe supply chamber. If the supply line is contracted at a distance L upstream of the final jet nozzle contraction, a standing wave whose length is approximately 4 L will exist in this chamber when the pipe resonates. The wave amplitude is dependent on the energy content of flow oscillations corresponding to a frequency equal to c/4 L, where c is the speed of sound in the liquid. If the organ-pipe length is tuned to a frequency which is amplified by the jet, the oscillation should grow in amplitude and cause a strong jet pulsation. The actual magnitude of amplification is best determined experimentally. This simple, self-excited acoustic oscillator appears well suited for taking advantage of the preferred jet structuring frequency discussed previously. Thus, a simple contracting nozzle of diameter $D_1$ fed by a pipe whose length L is approximately $D_1/4$ SM will tend to self-excite and produce discrete vortices when the jet is submerged or artificially submerged. (S is the preferred Strouhal number and M is the Mach number.)

FIG. *6e* illustrates another version of an acoustic-hydrodynamic resonator in which the organ-pipe is replaced by the Helmholtz resonator 4. Such devices are discussed in detail below.

The methods shown in FIGS. *6c*, *6d*, and *6e* may be termed pure fluid devices since they are entirely passive and require no outside energy supply. The energy for their operation comes only from the fluid and they depend on hydrodynamic and acoustic interactions for their operation.

The working fluid in most high-pressure jet erosion devices is water or water-based, with the speed of sound in the liquid being approximately 5,000 fps. The liquid velocity is usually greater than 500 feet per second (fps). For a Strouhal number of 0.45 the frequency required will then be greater than 225/d. The sound wavelength for this frequency is therefore shorter than 22.2 d. This short wavelength will tend to make an acoustic oscillator of some type particularly attractive, because such a device will be passive, without moving parts, and will have a geometrical size that can be readily incorporated in a nozzle system. For example, the simple organ-pipe device shown in FIG. *6d* should resonate at the preferred frequency if its length is approximately one quarter of the sound wavelength, say 5.5 d for a 500 fps jet. Another particularly attractive oscillator is the jet-driven Helmholtz oscillator.

I have found that for Mach numbers (M) greater than 0.1, when the geometry of such an oscillator is properly selected, it will cause modulation of the jet speed within a particular Strouhal number range and with sufficient amplitude to cause discrete vortices to form in submerged cavitating jets and so produce the enhanced erosion effects described above. Details of the various embodiments of such high pressure nozzle systems, which are termed herein "Pulser" nozzles, are described below.

BASIC PULSER

Figure 7:
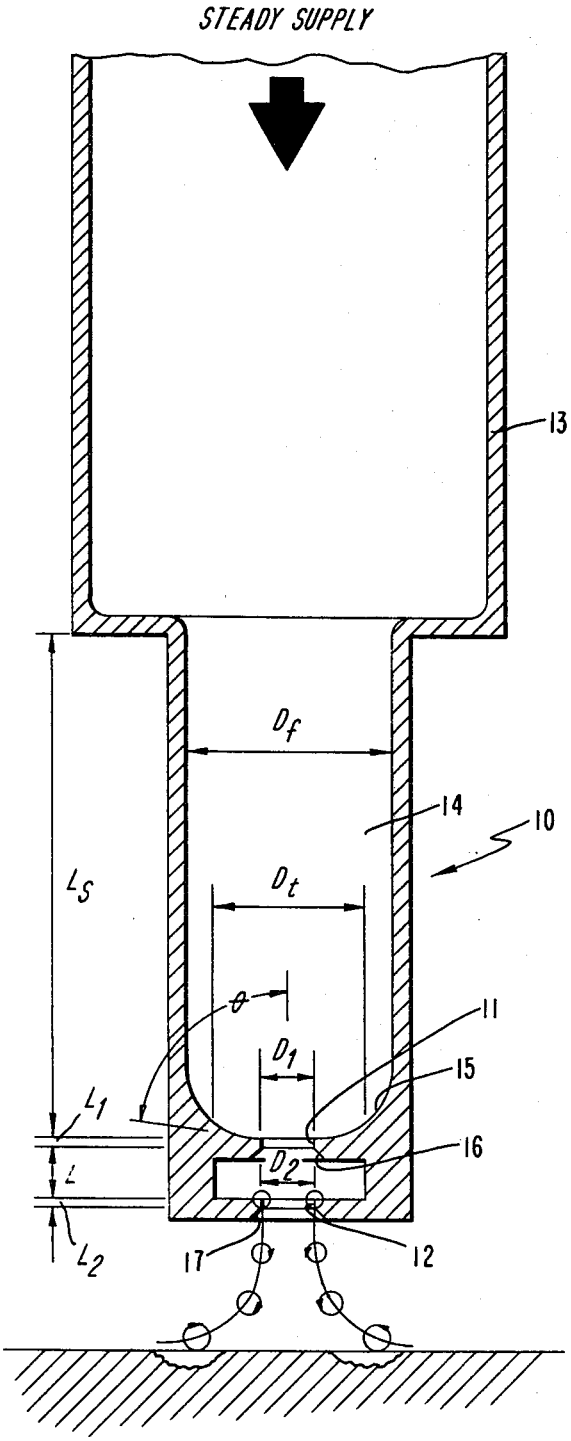
FIG. 7 shows a self-excited pulser nozzle used to improve submerged cavitating jet performance in accordance with the present invention.

FIG. 7 illustrates a specific nozzle system, referred to herein as the "Basic Pulser" nozzle system 10 designed to produce an oscillated liquid jet which structures itself into discrete vortices when submerged and thus cavitates and is more erosive than an unexcited jet. The oscillating exit velocity is produced by a hydrodynamic and acoustic interaction within a cavity volume formed by spacing two nozzles 11 and 12 in tandem an appropriate distance apart, and properly sizing the cavity volume.

In such a nozzle system, a steady flow of liquid is supplied from a supply line 13 to the nozzle system 10. The system 10 is comprised of an entrance section 14 having diameter $D_f$ and length $L_s$ terminating with a contraction from $D_f$ to $D_1$ with nozzle contour 15. An example of one preferred nozzle contour 15 is that shown for the conventional cavitating jet nozzle described in allowed U.S. patent application Ser. No. 931,244, the disclosure of which is hereby incorporated herein by reference to the extent required for a thorough understanding of the invention. The liquid passes through nozzle 11 having a straight length $L_1$, followed by a short tapered section 16. The liquid jet then enters the cavity volume V, which in a cylindrical form has diameter $D_t$. Discrete vortices form in the shear zone between the jet and the cavity volume and exit through a second nozzle 12 having diameter $D_2$ and having a straight length $L_2$ followed by a short tapered section 17. The distance between the exit of the first nozzle 11 and the entrance of the second nozzle 12 is designated L. The principle of operation of the Basic Pulser nozzle is described below.

If the jet formed by nozzle 11 is excited at its optimum Strouhal number, discrete vortices will be formed and these vortices will have a frequency of SdV/d and a definite wavelength, λ, as discussed previously. If a second orifice 12 is placed downstream at a distance L, a vortex arriving at orifice 12 will transmit a pressure signal upstream to the exit of orifice 11 in a time=L/c. If the distance L is selected so that $L=N\lambda-(L/c)f\lambda$, where N is an integer number of vortices, the pressure signal will arrive at orifice 11 at exactly the time required to excite a new vortex. This equation may be expressed non-dimensionally as $$\frac{L}{D_1} = \frac{N\lambda/D_1}{(1 + SM\lambda/D_1)} \tag{26}$$

where M is the Mach number, V/c.

The value of $\lambda/D_1$ may also be expressed as $1/S(V_c/V)$ where $V_c$ is the vortex convection velocity. Thus, equation (26) may also be written as $$\frac{L}{D_1} = \frac{N(V_c/V)}{S(1 + M\,V_c/V)} \tag{27}$$

I have found, in experiments with a mechanically excited water jet, that optimum generation of discrete vortices occurs at S=0.45 and 0.9. At this optimum condition, the observed value of $(V_c/V)$ was approximately 0.6. Prior art workers in air found that $(V_c/V)$ varied from 0.7 to 0.6 as S varied from 0.3 to 0.6. Thus, for design purposes, $(V_c/V)$ may be taken as 0.65. Equation (27) may then be approximated by $$\frac{L}{D_1} \cong \frac{.65N}{S(1 + .65M)} \tag{28}$$

The self-excitation caused by spacing the orifices according to equation (26) will be further amplified if the acoustic resonant frequency of the chamber volume is identical to the desired vortex frequency defined by the optimum Strouhal number.

The approximate equation for the cylindrical Helmholtz chamber resonant frequencies shown in FIG. 7 is $$f = \frac{c}{2\pi D_T}\sqrt{\frac{D_1}{L}} \tag{29}$$

The diameter ratio for the chamber may then be written in terms of the required Strouhal number and the Mach number as $$\frac{D_T}{D_1} = \frac{1}{2\pi SM}\sqrt{\frac{D_1}{L}} \tag{30}$$

where $D_1/L$ is given by equation (27) or (28).

If equation (28) is substituted into equation (30), the approximate equation for $D_T/D$, is $$\frac{D_T}{D_1} = \frac{.2}{M}\sqrt{\frac{1 + .65M}{NS}} \tag{31}$$

Since practical, high speed jet applications require the Mach number to be generally 0.1 or higher, the required value of $D_T/D_1$ must be less than 2.06/NS. If the optimum Strouhal number of 0.45, as found in my experiments with free jets, is applied to the jet in the cavity volume, then $D_T/D_1$ must generally be 3.1 or less. The actual optimum Strouhal number will depend on the degree of contraction of the jet leaving nozzle 11 in FIG. 7. For example, if the nozzle contour has an exit slope nearly parallel to the axis of flow, then the optimum Strouhal number is near 0.35 (or 0.7 for the second mode). Then $D_T/D_1$, for M=0.1, must generally be 3.8 or less.

It is not necessary that the cavity volume be cylindrical in shape as shown in FIG. 7. It is only necessary that the volume be equivalent to the volume given by equations (30) or (31). Thus, $$\frac{\text{Vol}}{D_1^3} = \frac{\pi}{4}\left(\frac{D_T}{D_1}\right)^2\left(\frac{L}{D_1}\right) = \frac{1}{16\pi S^2M^2} \tag{32}$$

The value given by equation (32) for the case of $S=0.45$ and $M=0.1$ is 9.8.

One other feature of the Basic Pulser nozzle that is preferred for satisfactory operation is the proper selection of the diameter of nozzle 12. I have found that best results are obtained by using the following equation for design purposes.

$$\frac{D_2}{D_1} = .2\left(4 + \frac{L}{D_1} + \cos\theta\right) \tag{33}$$

where $\theta$ is the angle between the nozzle axis and the exit slope of the nozzle contour 15 in FIG. 7.

I have also found from experiments that the performance of the Pulser nozzle is usually improved if entrance section 14 is selected to have a length $L_s$ approximately equal to one quarter of the sound wavelength corresponding to the desired Strouhal number (or higher modes, 3/4, 5/4 . . . ). Thus, $$\frac{L_s}{D_1} \cong \frac{c}{4f} \cong \frac{1}{4MS} \tag{34}$$

Although the diameter $D_f$ of the entrance section is not crucial to the operation of the Basic Pulser nozzle, as long as $D_f \geqq D_1$, it is preferred that $D_f/D_1$ be greater than 2. Although it need not be greater than 4.

I have also found that best performance is achieved when N is 1, 2 or 3 and preferably when $N=1$.

The following table summarizes the dimensions and dimensional ratios typical of practical Basic Pulser nozzles designed in accordance with the present invention for high pressure liquid jet applications where the Mach number is greater than 0.08, and usually in the range 0.1 to 0.3.

| Dimension Or Dimensional Ratio | Typical Values | Equation No. |
|---|---|---|
| $D_1$ | <20 mm typically <10 mm | — |
| $\frac{D_f}{D_1}$ | 1 to 6, preferably 2 to 4 | — |
| $\frac{D_2}{D_1}$ | 1.0 to 1.4 | (33) |
| $\frac{D_T}{D_1}$ | <4.0, typically <3.5 (Mach number 0.1) | (30) |
| $\frac{Vol}{D_1^3}$ | <14.0, typically <10 (Mach number 0.1) | (32) |
| $\frac{L_1}{D_1}$ | preferably near 0 | — |
| $\frac{L}{D_1}$ | 0.5 to 6.0, preferably 0.5 to 2.0 | (28) |
| $\frac{L_2}{D_1}$ | <1.0, preferably near 0 | — |

I have tested the Basic Pulser nozzle in both air and water and found that rms velocity fluctuations as high as 0.5 were obtained, and that both cavitation inception and erosion of a boundary were considerably greater than for simple, non-excited jets.

Contrary to prior art teachings which would tend to discourage the use of such a pulser nozzle at Reynolds numbers higher than $10^4$ and at Mach numbers greater than 0.1, and more particularly at values of $D_T/d_1<4$ or $Vol/D_1^3<14$, I have found that the Basic Pulser nozzle system described above produces precisely the effect needed for enhanced cavitation when designed within the ranges specified above.

I have further found, in some applications of the form of the Basic Pulser nozzle, for example in the extended nozzles of some conventional roller drill bits, the value of $D_T/D_1$ may be constrained to be as small as about 2.0. I have found that even for this small value, a form of the Basic Pulser nozzle system can be designed to operate successfully. For these constrained applications another embodiment of the invention, referred to herein as the "Laid-Back Pulser" nozzle may be preferred.

LAID-BACK PULSER

Figure 8:
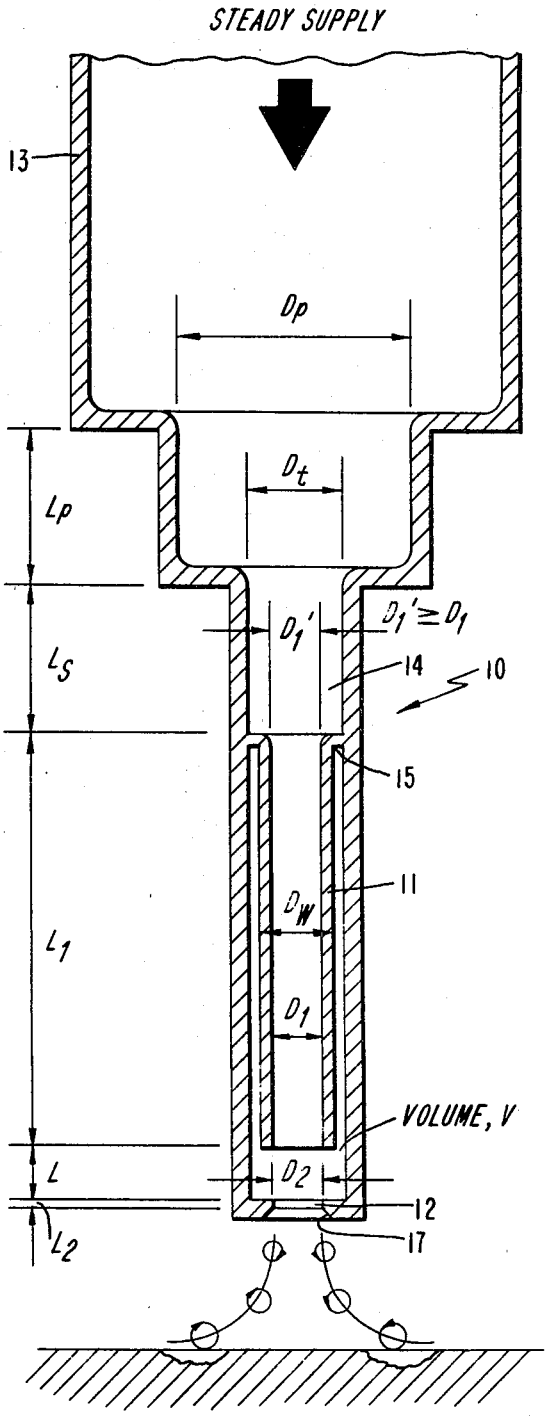
FIG. 8 shows a further embodiment of a self-excited pulser nozzle constructed in accordance with the present invention.

FIG. 8 illustrates another embodiment of the Pulser system which has been found to be satisfactory when the value of $D_T/D_1$ is constrained so as to be not achievable by applying the basic Pulser design principles discussed above. In the Laid-Back Pulser, the value of $Vol/D_1^3$ given by equation (32) is achieved by lengthening the value of $L_1$ sufficiently to add the required volume in the annular space around the resulting long nozzle. For example, if $D_1'=D_1$, $L_1/D_1$ may be obtained from the following equation.

$$\frac{Vol}{D_1^3} = \frac{\pi}{4}\left[\left(\frac{D_T}{D_1}\right)^2 - \left(\frac{D_W}{D_1}\right)^2\right]\frac{L_1}{D_1} + \frac{\pi}{4}\left(\frac{D_T}{D_1}\right)^2\frac{L}{D} \cong \frac{1}{16\pi S^2M^2} \tag{35}$$

In the Laid-Back Pulser embodiment shown in FIG. 8, a steady flow of liquid is supplied from a supply line 13 to the nozzle 10. The supply line 13 may have several steps, as shown, to reach the constrained diameter $D_t$. One such step might be through diameter $D_f$. Such a step would be useful in reducing the pipe losses between the supply 13 and the nozzle 10 if the distance $L_p$ is very large. The nozzle 10 is comprised of an entrance section 14 having the constrained diameter $D_f=D_t$ and length $L_s$ terminating in a contraction 15 from $D_T$ to entrance diameter $D_1'$. The liquid then passes through nozzle 11 having a length $L_1$ and an exit diameter $D_1$ (where $D_1' \geqq D_1$). The liquid jet then enters the cavity volume V, which has the constrained diameter $D_t$. Discrete vortices form in the shear zone between the jet and the cavity volume and exit through a second nozzle 12 having a diameter $D_2$ and having a straight length $L_2$ followed by a short tapered section 17. The distance between the exit of the first nozzle 11 and the entrance of the second nozzle 12 is designated L. The cavity volume V has a total length of $L+L_1$ and is given by equation 35, which depends on the outer diameter $D_w$ of nozzle 11.

The principle of operation of the Laid-Back Pulser is the same as that described for the basic Pulser.

Such a Laid-Back Pulser has been designed for $M=0.1$ and tested in air. Jet velocity rms amplitudes as high as 30% of the mean velocity were measured. Such a nozzle, when tested in water, should also produce enhanced cavitation characteristics. I found that for the specific design tested, that if $D_f=20$ cm, $D_1=8$ mm, and $D_T/D_1=2$, $L_1/D_1=8$, resonance could be achieved in the first three modes, i.e., $L/D_1=1, 2, 3$.

The following table summarizes the dimensions and dimensional ratios typical of practical Laid-Back Pulser nozzles designed for high pressure liquid jet applications where the Mach number is greater than 0.08, and usually in the range 0.1 to 0.3.

| Dimension or Dimensional Ratio | Typical Values | Equation Number |
|---|---|---|
| $D_1$ | <20 mm, typically <10 mm | — |
| $D_f/D_1$ | $=D_T/D_1$, typically <3 | — |
| $D_2/D_1$ | 1 to 1.4 | (33) |
| $D_T/D_1$ | typically <3 | — |
| $Vol/D_1^3$ | <14.0, typically <10(M > 0.1) | (32), (35) |
| $L_1/D_1$ | >0, typically 1.0 to 20.0 | (35) |
| $L/D_1$ | 0.5 to 6.0, preferably 0.5 to 2.0 | (28) |
| $L_2/D_1$ | <1.0, preferably near 0 | — |

PULSER-FED

Either the Basic Pulser nozzle or the Laid-Back Pulser nozzle, as shown in FIGS. 7 & 8, respectively, will oscillate the flow so as to improve the cavitating performance of a submerged or artifically submerged jet, or cause the impact erosion of a jet in air to improve because of the intermittent percussive effect. However, I have found that the vortices (in a submerged jet) are more precisely formed if the pulser (resonator) chamber which produces the excitation is formed some distance from the exit nozzle, rather than actually functioning as the discharging nozzle. Such a pulser device is denoted herein as "Pulser-Fed" and is illustrated in FIG. 9.

There are three advantages of the Pulser-Fed nozzle configuration.

These are:

(1) The amplitude of the modulation may be established by the proper choice of the configuration of the diffusion chamber 18 which is situated in tandem with the pulser.

(2) The radial velocity distribution across the jet forming discharge nozzle can be made more uniform and thus the vortices or slugs formed are more cleanly defined.

(3) The pulser may be selected to operate at a higher Strouhal number than that of the discharge orifice and thus the pressure inside the resonator chamber can be made higher than the ambient pressure to which the final jet forming nozzle discharges. Also the jet velocity in the resonator chamber is lower than the final jet velocity. Thus the cavitation number in the pulser is much higher than the final jet cavitation number and the chamber can be designed to operate cavitation free even when the cavitation number at the free jet is nearly zero.

The disadvantage of the Pulser-Fed system is that the overall energy loss (caused by losses in the diffusion chamber) is greater than for a Basic or Laid-Back Pulser configuration. These losses may be minimized by using the alternate diffusion chambers shown in FIGS. 9*b* and 9*c*.

Figure 9A:
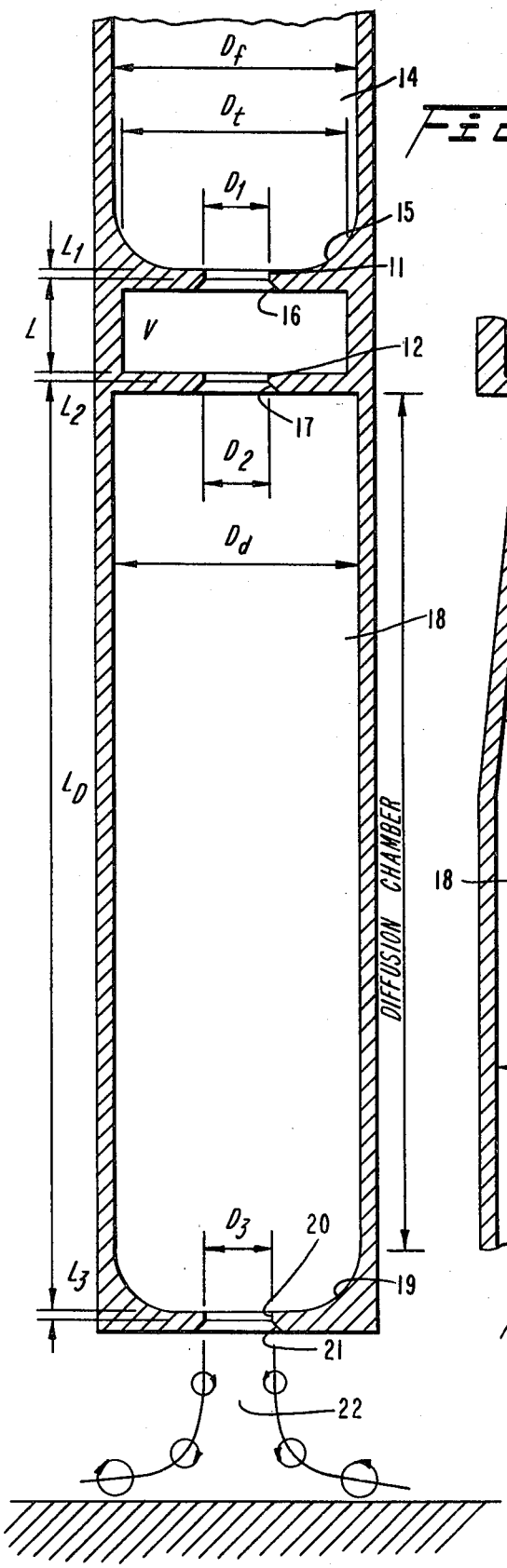
FIG. 9 shows further embodiments of a self-excited pulser nozzle constructed in accordance with the present invention.

In the Pulser-Fed embodiment of the invention shown in FIG. 9*a* a liquid passes from a supply into the entrance section 14 of diameter $D_f$ terminating with a contraction from $D_f$ to $D_1$ with nozzle contour 15. The liquid passes through nozzle 11 having a straight length $L_1$ followed by a short tapered section 16. The liquid jet then enters the cavity volume V, which in a cylindrical form has diameter $D_T$. Discrete vortices form in the shear zone between the jet and the cavity volume and exit through a second nozzle 12 having diameter $D_2$ and having a straight length $L_2$ followed by a short tapered section 17. The distance between the exit of the first nozzle 11 and the entrance of the second nozzle 12 is designated L. It will be recognized that this portion of the Pulser-Fed nozzle is exactly the pulse nozzle shown in FIG. 7 and previously described. Although not shown, it will be clear that another embodiment of the invention is a Laid-Back Pulser-Fed configuration in which the feeding Pulser nozzle of FIG. 9*a* is replaced by a Laid-Back Pulser nozzle.

In the Pulser-Fed embodiment shown in FIG. 9*a* liquid passes from nozzle 12 into a diffusion chamber 18 having diameter $D_d$ and length $L_d$. The liquid then enters a contraction section from diameter $D_d$ to $D_3$ through a nozzle contour 19. An example of one nozzle contour preferred for use as contour 15 and contour 19 is that shown for the conventional cavitating jet nozzle described in U.S. patent application Ser. No. 931,244. The liquid then passes through exit nozzle 20 having a diameter $D_3$ and a straight length $L_3$ followed by a short tapered section 21.

The principle of operation of the Pulser-Fed nozzle upstream of the exit of pulser nozzle 12 is the same as previously described for the basic Pulser. The jet discharging from nozzle 12 oscillates or pulses as it enters chamber 18. This piston-like oscillation is transmitted hydrodynamically and acoustically to the nozzle 20 and excites the discharge from the nozzle 20 at the same frequency as the pulser frequency. The amplitude of the excitation at exit nozzle 20 is less than the amplitude of the Pulser jet because of attenuation in chamber 18. The excitation in chamber pressure at nozzle 20 causes structuring of the jet into discrete vortices if the Strouhal number of the exit jet $S=fD_3/V_3$, based on the exit nozzle diameter $D_3$ and the exit velocity $V_3$, is near the optimum value. My experiments have shown that the Pulser-Fed nozzle does result in discrete vortices that are more well-defined and not as irregular as those generated by the Basic Pulser or Laid-Back Pulser. The reason for this is that the diffusion chamber provides a uniform inflow to exit nozzle 20.

Although the Pulser-Fed nozzle may be designed with the pulser Strouhal number identical to the exit nozzle Strouhal number, in order to achieve the well-defined vortex flow in the exit; an additional important feature of the Pulser-Fed nozzle is achieved when the Strouhal number of the pulser nozzle 12 is taken as twice the optimum Strouhal number of the exit nozzle 20.

As discussed previously, I have found in experiments in water that the optimum Strouhal number for the achievement of discrete vortices is 0.45 with a reoccurence of the phenomenon at twice this value 0.90.

If the pulser nozzle Strouhal number is taken as twice the exit jet Strouhal number the pulser entrance nozzle 11 diameter $D_1$ will be larger than the exit nozzle 20 diameter $D_3$ and thus the average pressure within the pulser will be higher than the ambient pressure, $P_a$, at the exit jet and the pulser jet velocity will be lower than the exit jet velocity. Thus the local operating cavitation number within the pulser section will be higher than the operating cavitation number of the exit jet. This effect is so great that it generally suppresses cavitation within the Pulser section even when the exit jet operating cavitation number is nearly zero. A further advantage of this type design ($S_{D1}=2S_{D3}$) is that the energy loss in the diffusion chamber 18 is greatly reduced (for a given exit velocity) because the pulser jet velocity is lower than the exit jet velocity.

Thus the preferred configuration of the Pulser-Fed nozzle is determined by choosing the pulser Strouhal number to be twice that of the exit Strouhal number. That is, $$\frac{fD_1}{V_1} = 2\frac{fD_3}{V_3}, \frac{D_1}{V_1} = \frac{2D_3}{V_3} \tag{36}$$

From the continuity equation, $$C_{D1}V_1D_1^2 = C_{D3}V_3D_3^2 \tag{37}$$

where $C_{d1}$, and $C_{d3}$ are the discharge coefficients of nozzle 11 and 20 respectively.

Combining equations (36) and (37) gives $$\frac{V_1}{V_3} = \frac{M_1}{M_3} = \left(\frac{1}{4}\ \frac{C_{D3}}{C_{D1}}\right)^{\frac{1}{3}} = .63\left(\frac{C_{D3}}{C_{D1}}\right)^{\frac{1}{3}} \tag{38}$$

and $$\frac{D_1}{D_3} = 2\left(\frac{1}{4}\ \frac{C_{D3}}{C_{D1}}\right)^{\frac{1}{3}} = 1.26\left(\frac{C_{D3}}{C_{D1}}\right)^{\frac{1}{3}} \tag{39}$$

If nozzle contours 15 and 19 are similar in shape and have contraction ratios $D_f/D_1$ and $D_d/D_3$ that are not greatly different, $D_{D3}$ may be assumed equal to $C_{D1}$ for preliminary design purposes. Otherwise $C_{D1}$ and $C_{D3}$ must be obtained from Handbook values or experiment for the particular nozzle contours used.

The oscillating pressure field at the Pulser exit nozzle 12 is best transmitted if the length of the diffusion chamber 18 is selected so as to be near resonance. This length $L_D$ is best selected by experiment, but for preliminary design purposes the length $L_D$ should be selected to be approximately one-half the acoustic wavelength.

Thus, $$L_D \simeq D/2SM \tag{40}$$

The following table summarizes the dimensions and dimensional ratios typical of practical Pulser-Fed nozzles designed for high pressure liquid jet applications where the exit Mach number, $M_3$, is greater than 0.08 and usually in the range 0.1 to 0.3.

| Dimension or Dimensional Ratio | Typical Values | Equation Number |
|---|---|---|
| $D_3$ | <20 mm, typically <10 mm | — |
| $D_1/D_3$ | 1.0 to 1.5, preferably 1.26 | (39) |
| $D_f/D_1$ | 1.0 to 6, preferably 2 to 4 | |
| $D_2/D_1$ | 1.0 to 1.4 | (33) |
| $D_T/D_1$ | <6.0, typically <5.0 ($M_3$ = 0.1) | (30), (38) &S=2$S_{D3}$ |
| $Vol/D_1^3$ | <35, typically <25 ($M_3$ = 0.1) | (32), (38) &S=2$S_{D3}$ |
| $L_1/D_1$ | Preferably Near Zero | |
| $L/D_1$ | 0.5 to 6.0, preferably 0.5 to 2.0 | (28), (38) &S=2$S_{D3}$ |
| $L_2/D_1$ | <1.0, preferably near 0 | |
| $D_d/D_2$ | >1.2, preferably 1.2 to 3.0 | |
| $L_d/D_d$ | 5.0 to 10.0 | (40) |
| $L_3/D_3$ | Preferably Near Zero | |

It should be recognized that a Laid Back Pulser-Fed embodiment may be designed by substituting a Laid-Back Pulser for the pulser described above.

It is clear that the energy loss associated with the Pulser-Fed nozzle may be reduced by using a conical rather than a cylindrical diffusion chamber. Two versions of alternate diffusion chambers are shown in FIGS. 9b and 9c.

Figure 9B:
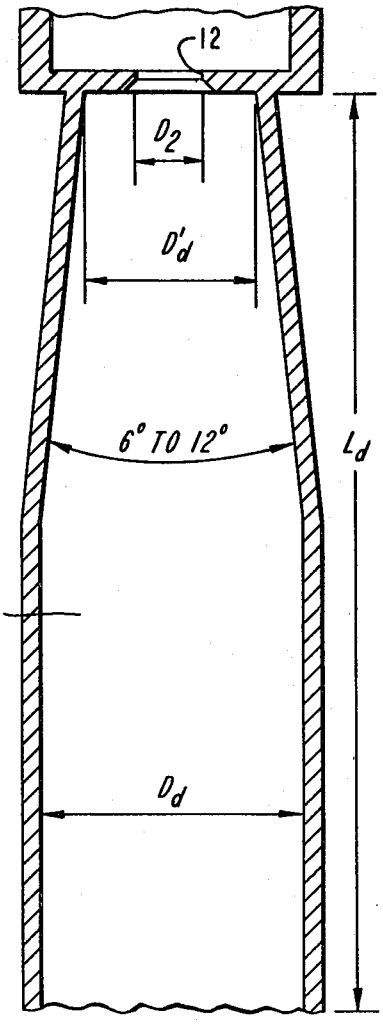

In FIG. 9b the diffusion chamber 18 consists of a conical section starting with diameter $D_d'$ and expanding to the diameter $D_d$ though a 6° to 12° cone.

Figure 9C:
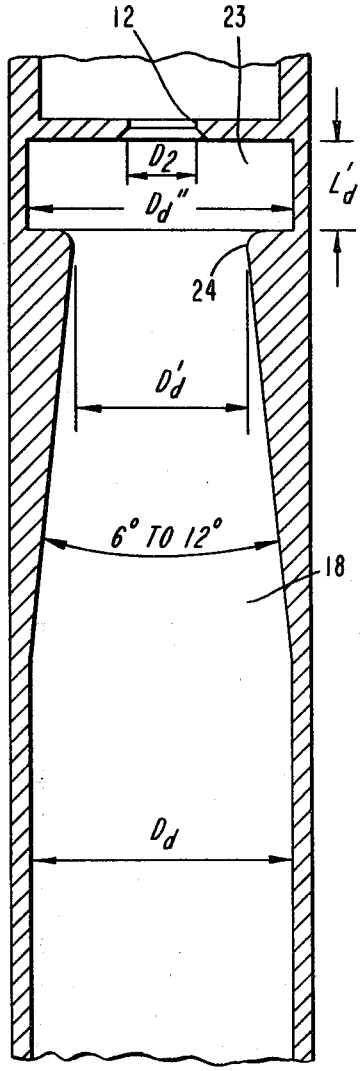

In FIG. 9c the nozzle 12 is followed by a chamber 23 having diameter $D_d''$ and length $L_d'$. The flow then passes into a 6° to 12° cone through a rounded inlet having diameter $D_d'$. The conical section terminates in a cylindrical section having diameter $D_d$. The preferred value of $D_d''/D_d$ and and $L_d'/D_2$ is approximately 1.0. The preferred range of $D_d'/D_2$ is 1.2 to 2.0.

FORCED EXCITATION EXPERIMENTS

In order to confirm that a submerged liquid jet would structure itself into discrete ring vortices if the jet is excited at the proper Strouhal number, and furthermore, that cavitation would be incipient in these discrete vortices at higher incipient cavitation numbers than for an unexcited jet, a preliminary experiment was carried out.

Figure 10:
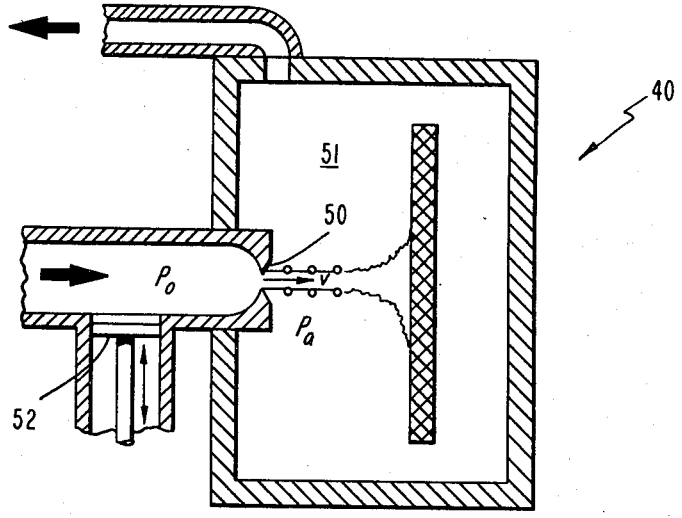
FIG. 10 is a schematic diagram illustrating a test rig used to demonstrate certain principles of the present invention.

A recirculating water tunnel 40 was constructed in such a way as to mechanically oscillate the flow from a submerged jet issuing from a ¼" diameter orifice. A schematic diagram of the test set-up is shown in FIG. 10. A jet having mean velocity V issued from the nozzle 50 having an upstream pressure $P_o$ into a chamber 51 having a pressure $P_a$. The value of $P_o$ and $P_a$ could be varied so as to vary the jet velocity V and the cavitation number $\sigma$. Oscillations of a selected frequency and amplitude were superimposed on the upstream pressure $P_o$ by mechanically oscillating the piston 52 shown in the supply line.

It was found that, when the cavitation number was sufficiently below the inception value so that cavitation was visible, excitation of the jet at amplitudes of several percent of $(P_o-P_a)$ resulted in dramatic changes in the appearance of the cavitation when the Strouhal number was 0.45. This structuring of the jet into discrete vortices was again observed when the Strouhal number was 0.9. A typical photograph of the change in cavitation pattern with excitation is shown in FIGS. 11a, 11b, and 11c. FIG. 11a shows the pattern for no excitation, while FIGS. 11b and 11c show the pattern when the jet was excited at frequencies of 5156 Hz and 10,310 Hz respectively. The jet velocity was 76.36 m/sec. (221 fps) and $\sigma$=0.23. FIGS. 11b and 11c thus correspond to Strouhal numbers of 0.45 and 0.90.

Figure 12:
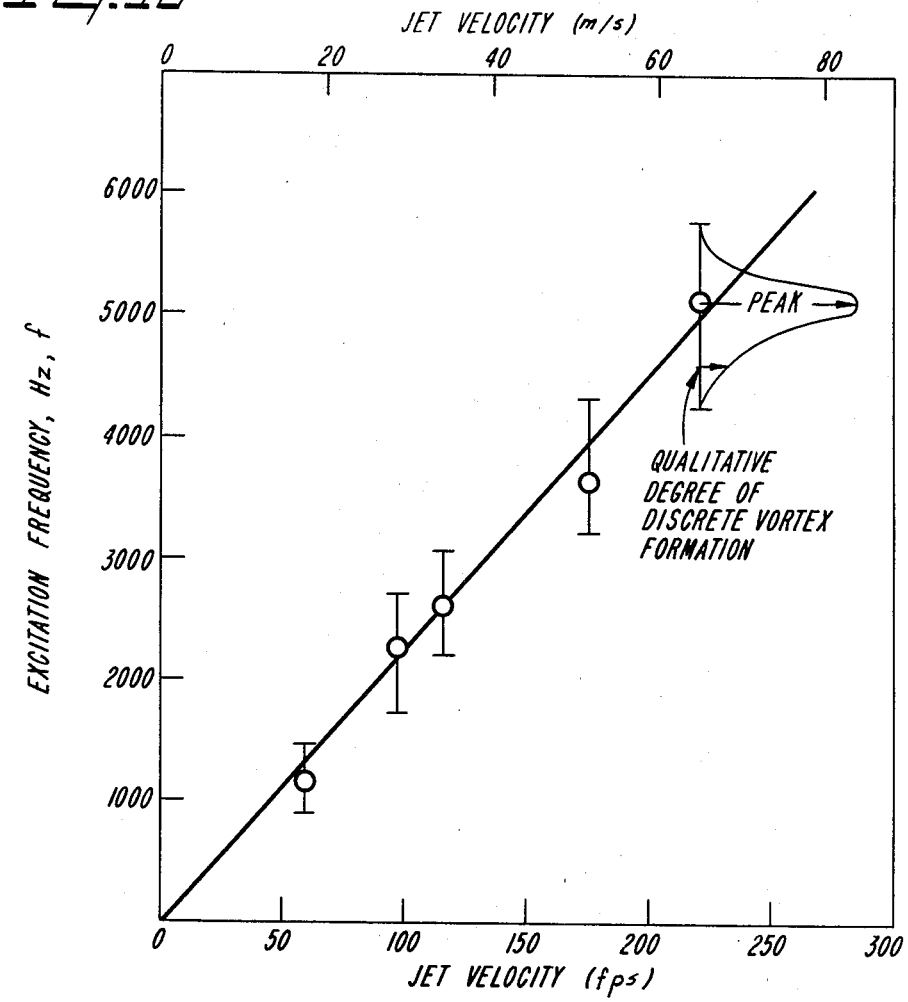
FIG. 12 is a graph showing the observed relationship between the excitation frequency and the jet velocity in the formation of discrete vortices.

FIG. 12 shows the observed relationships between the excitation frequency and the jet velocity for which there was a high degree of discrete vortex formation in experiments testing the system shown in FIG. 10. The line through the data corresponds to a Strouhal number of 0.45. Similar data were found for twice this value of Strouhal number, S=0.9.

Figure 13:
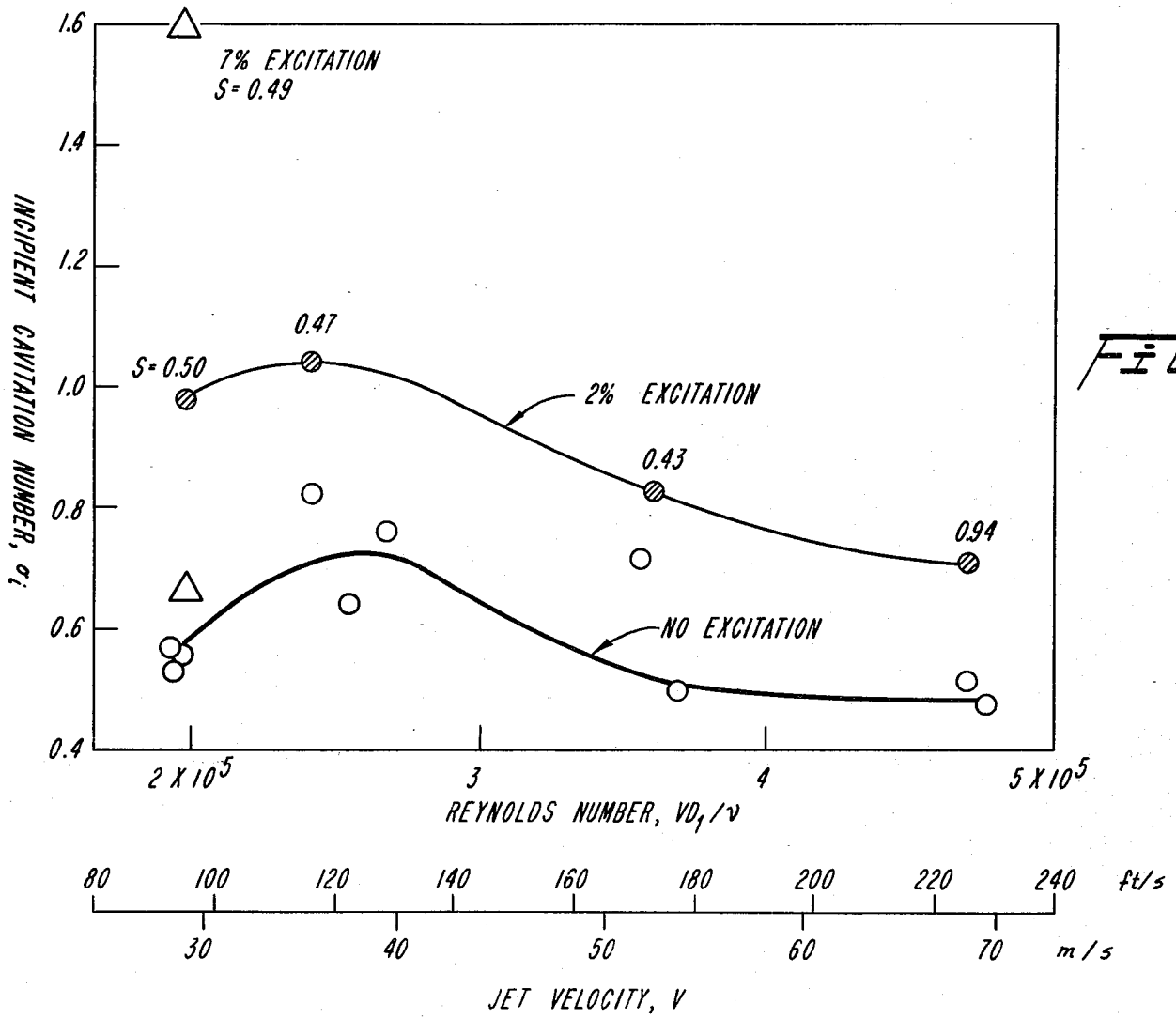
FIG. 13 is a graph showing the observed values of incipient cavitation number for various jet velocities and Reynolds numbers, with and without excitation of the jet.

FIG. 13 shows the observed values of incipient cavitation number $\sigma_i$ using the test rig shown in FIG. 10 for various jet velocities or Reynolds numbers for the case of no excitation, 2% excitation, and 7% excitation. (Percent excitation means excitation amplitude $\div(P_o-P_a)\times 100$). The data show that the incipient cavitation number was nearly doubled for 2% excitation and more than tripled for 7% excitation.

It is significant to note in FIGS. (12) and (13) that the creation of discrete vortices was accomplished at Reynolds numbers ($Vd/\nu$, where $\nu$ is the kinematic viscosity) of nearly $5\times10^5$. This result is contrary to the teachings of U.S. Pat. No. 3,398,758 and is not suggested by any other prior art workers.

EXPERIMENTS USING SELF EXCITED NOZZLES

Several versions of the self-excited pulser nozzles described above were built and tested and compared with conventional cavitating jet nozzles. The nozzle contour of each of the conventional cavitating jet nozzles tested was substantially as described in U.S. patent application Ser. No. 931,244.

Figure 14:
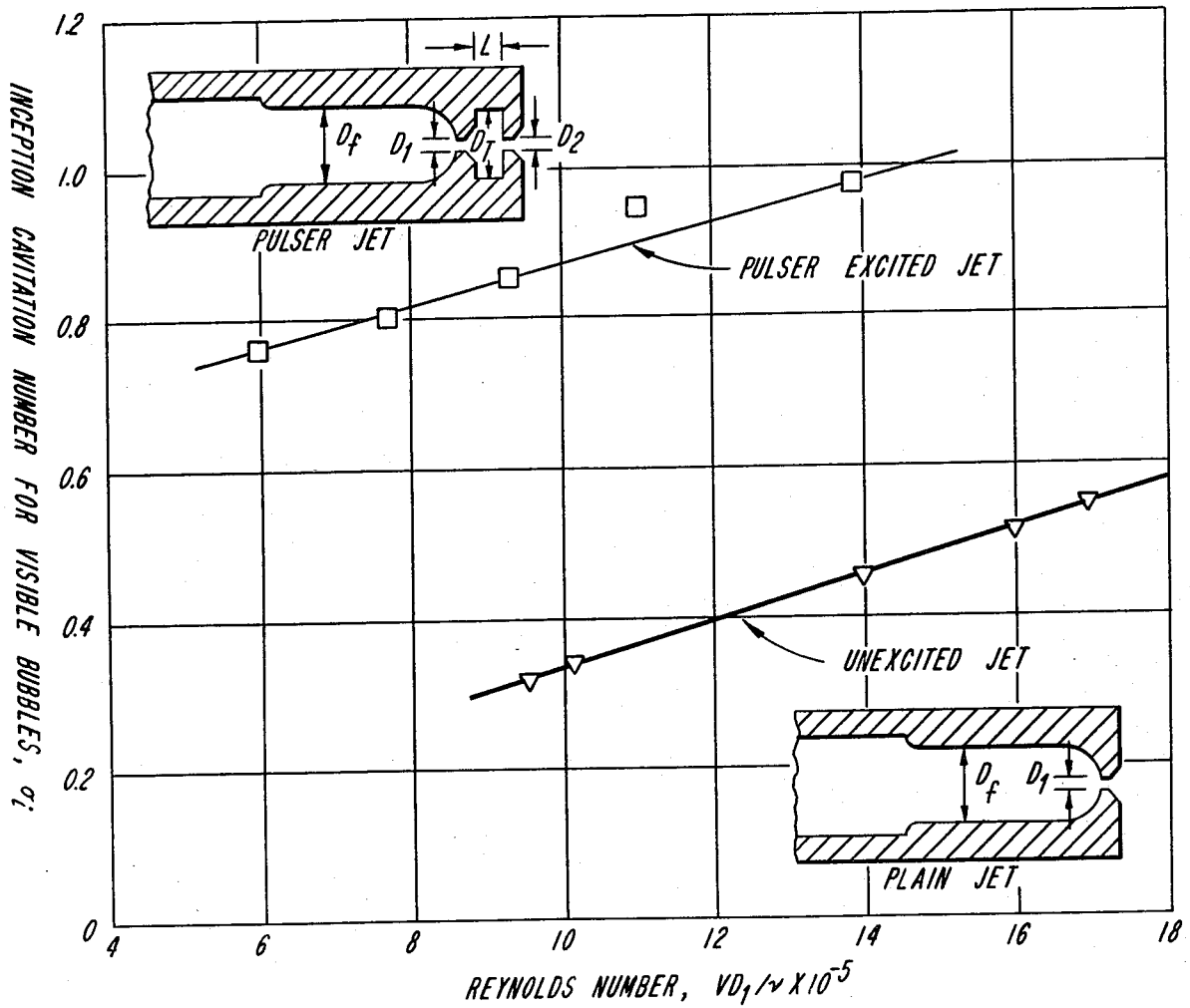
FIG. 14 shows the difference in incipient cavitation number observed between a pulser excited and an unexcited cavitating jet, and illustrates the configuration of the two nozzles tested.

FIG. 14 shows the difference in incipient cavitation number between a conventional cavitating jet nozzle and a pulser nozzle of the same diameter for a range of Reynolds numbers. Details of construction of each nozzle are shown in the figure. The pulser nozzle was observed to have an incipient cavitation index twice that of the conventional cavitating jet nozzle. For the pulser nozzle, $D_1=6.2$ mm (0.244 in.), $D_2=5.6$ mm (0.220 in.), $D_T=22.4$ mm (0.88 in.), $D_f=25.4$ mm and $L=10.6$ mm (0.416 in.); and for the plain cavitating jet nozzle, $D_f=1.0$ in. (25.4 mm) and $D_1=6.2$ mm (0.244 in.).

Figure 15:
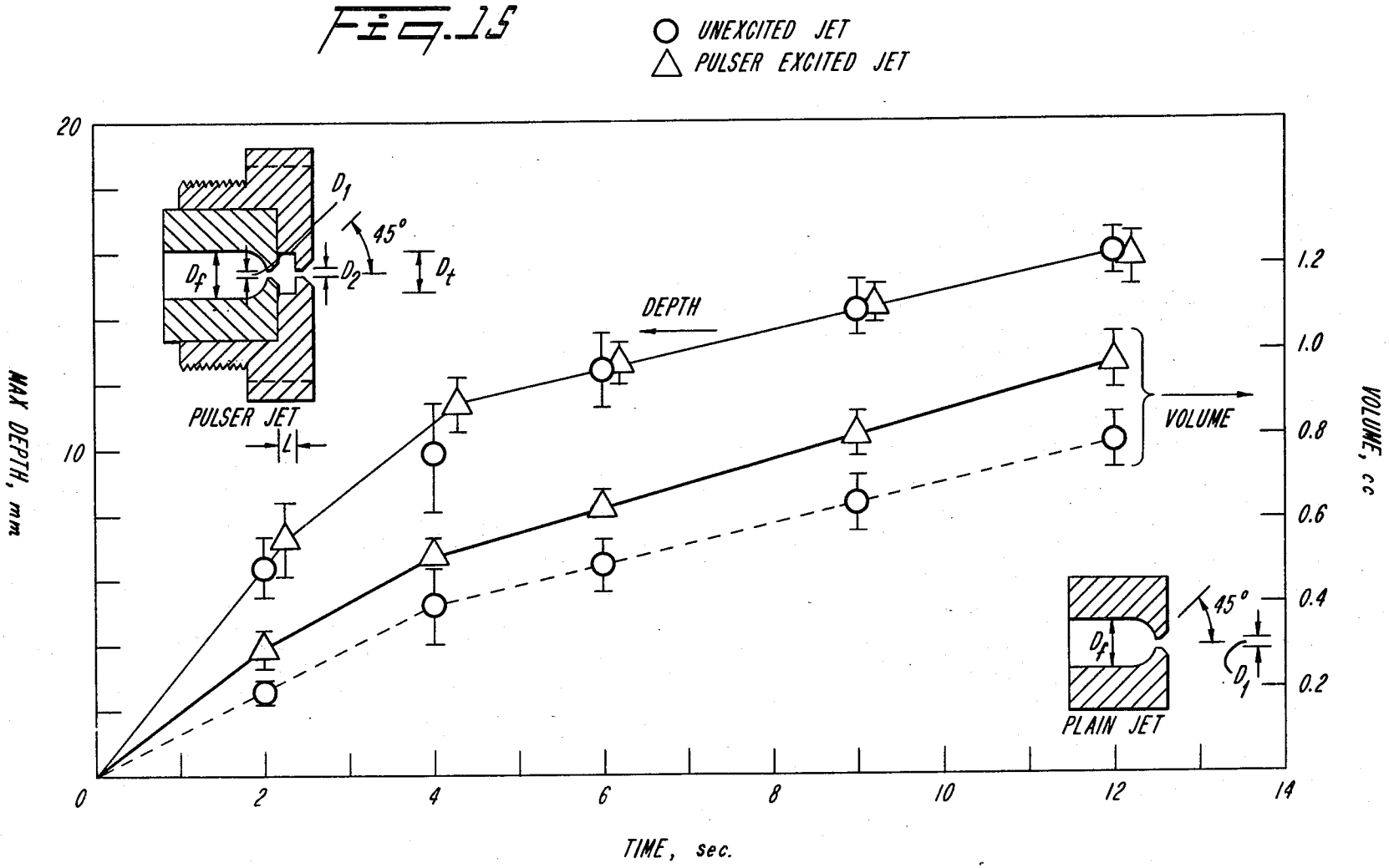
FIG. 15 is a graph showing a comparison of depth and volume erosion histories observed with an unexcited jet and a pulser-excited jet, and illustrates the configuration of the two nozzles tested.

FIG. 15 compares the depth and volume of erosion of a Pulser nozzle and a conventional cavitating jet nozzle having the same 2.2 mm diameter when each was tested at a low cavitation number ($\sigma\simeq0.015$) and with a jet velocity corresponding to a Mach number of approximately 0.08 and $D_T=0.36$ inch. The configuration of each nozzle are shown in the Figure. Although the depth of erosion was about the same for both nozzles, the volume of erosion was approximately 20% greater for the Pulser nozzle. The test material was Berea Sandstone and the material was located approximately 10 diameters from the nozzle exits.

Figure 16A:
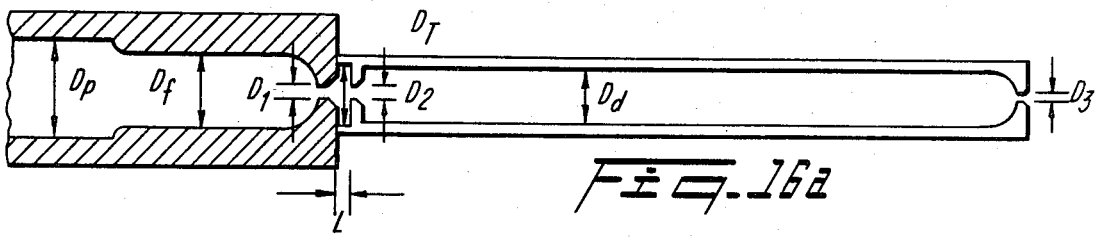
FIGS. 16*a* and 16*b* show the configuration of a Pulser-Fed nozzle which was constructed in accordance with the invention and a conventional cavitating jet nozzle which was constructed to have equivalent discharge characteristics for comparative testing purposes.
Figure 16B:
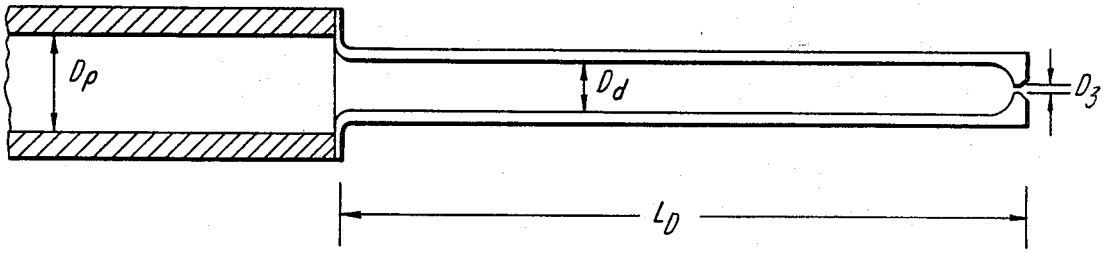

FIG. 16*a* shows the configuration of a Pulser-Fed nozzle which was constructed in accordance with the invention, and FIG. 16*b* shows a conventional cavitating jet nozzle which was constructed to have equivalent discharge characteristics for comparative testing purposes. In the Pulser-Fed nozzle of FIG. 16*a* $D=1.0$ inch, $D_1=D_2=0.25$ inch, $D_T=0.75$ inch, $D_3=0.196$ inch, $D_d=0.68$ inch, $L_D=8.75$ inches $L=0.20''$, while in the plain cavitating jet nozzle of FIG. 16*b*, $D_P=1.38$ inches, $D_d=0.68$ inch, $D_3=0.196$ inch and $L_D=8.75$ inches. In experiments using these two nozzles at a cavitation number of 0.25 and a velocity of 400 fps, discrete vortices were formed by nozzle 16*a* and spread over the boundary as anticipated from the previous discussion. Such vortices were not produced by nozzle 16*b*.

Figure 17:
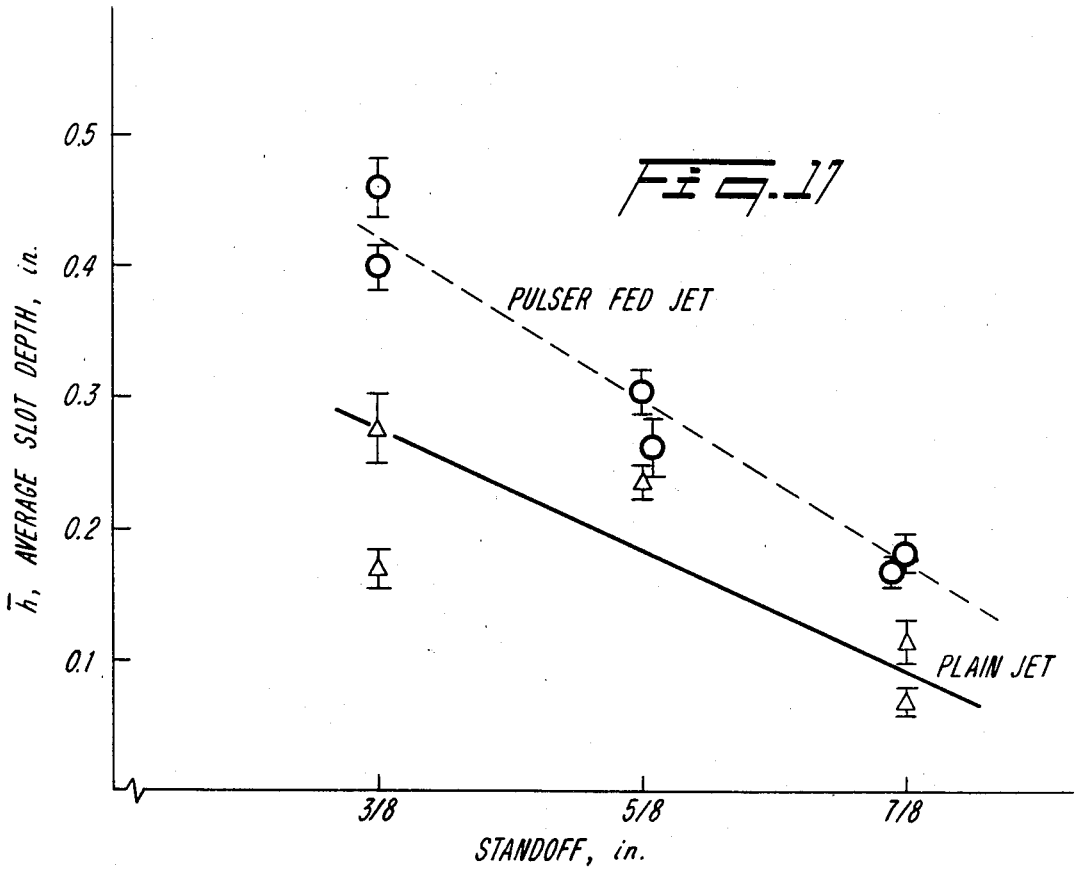
FIG. 17 is a graph showing a comparison of the depth of erosion observed for the two nozzles shown in FIG. 16.

FIG. 17 presents a comparison of the depth of erosion measured in Berea Sandstone for a range of stand-off distances for the Pulser-Fed nozzle shown in FIG. 16*a* and a plain jet nozzle of FIG. 16*b* having equivalent discharge (and exit diameter equal 0.196 inches). The data shown are for a cavitation number of 0.50 and a jet velocity of 365 fps. FIG. 17 shows that the depth of erosion is approximately 65% greater for the Pulser Fed nozzle 16*a*. It is important to recognize that FIG. 17 compares the two nozzles at the same jet velocity and not the same total pressure drop across each system. In these tests the pressure across the Pulser-Fed system was approximately 25% greater than across the other nozzle. Thus, practical Pulser-Fed nozzles should incorporate lower loss diffuser chambers such as those shown in FIGS. 9*b* and 9*c*.

Stationary jet drilling tests were made in Sierra White granite specimens. These tests compared the drilling rates of three different sizes of conventional (plain) cavitating jet nozzles ($D=0.1$ inch, 0.204 inch and 0.28 inch) and a Basic Pulser nozzle with $D_1=D_2=0.204$ inch. The plain cavitating jet nozzles, with diameter 0.1 inch and 0.281 inch were tested simultaneously (side by side with fluid supplied from the same plenum) and the 0.204 inch diameter plain cavitating jet and Basic Pulser were tested simultaneously in the same manner in a second test. The test variables in both tests included a nozzle pressure drop range of 1000 to 6000 psi and a cavitation number range of 0.1 to 2. The nozzle standoff distance for all tests was 0.563 inch.

The results obtained may be summarized as follows for a nozzle pressure drop of 5000 psi:

(1) the 0.1 inch diameter plain cavitating jet produced negligible penetration for all conditions;

(2) the 0.283 inch diameter plain cavitating jet produced a penetration rate which varied from 0.1 mm/sec to 0.03 mm/sec for cavitation numbers varying from 0.15 to 1.0; and (3) both the 0.204 inch diameter plain cavitating jet and the 0.204 inch pulser produced penetration rates of approximately 0.3 mm/sec for cavitation numbers varying from 0.15 to 1.0.

Since my previous experience has shown that the penetration rate for plain cavitating jet nozzles increases with nozzle size, the 0.204 inch diameter plain cavitating jet nozzle would have been expected to produce a penetration rate less than that obtained with the 0.283 inch diameter plain cavitating jet. The very high penetration rate obtained with the 0.204 inch diameter plain cavitating jet when tested alongside the 0.204 inch diameter Basic Pulser nozzle indicates that it was excited by the adjacent pulser excitation to produce a penetration rate similar to the Basic Pulser. The test results clearly demonstrate the improved performance of jets excited at or near the preferred Stouhal number. Furthermore, the tests showed that the jet from a non-pulser (i.e., conventional cavitating jet) nozzle can be excited by an adjacent pulser nozzle.

I have thus found that a pulser nozzle supplied from the same plenum as non-pulser nozzles and discharging into the same chamber as non-pulser nozzles will excite the non-pulser nozzle jets and cause them to operate as excited jets, as described above. This phenomenon may be applied in any manifolded jet system to improve the performance of the system. For example, FIG. 18 illustrates the use of a central pulser nozzle to excite the plain cavitating jet nozzles located in the extended arms of a two or three cone roller bit used in deep hole drilling.

FIG. 18 shows the extended arms and jets used in two and three cone roller bits for supplying drilling fluid to the hole bottom during drilling. Drilling fluid from the drill pipe plenum 70 is supplied to the conventional cavitating jet nozzles 71 located near the hole bottom 72 through extended arms 73 and also through a centrally located nozzle 74. In this embodiment of the invention the central nozzle 74 is a pulser nozzle designed to produce a frequency of pulsation that results in a Strouhal number based on the diameter and velocity of plain cavitating jet nozzles 71 in the range 0.2 to 1.2 and preferably at 0.45 or 0.90.

Acoustic waves propagated from the central pulser nozzle 74 excite nozzles 71 so as to create discrete vortices 75 and thus erode the hole bottom 72 at rates higher than if nozzle 74 were not a pulser nozzle oscillating at the preferred Strouhal number.

It will be apparent to those skilled in the art that various modifications and variations can be made in the method and apparatus of the present invention without departing from the scope or spirit of the invention. As an example, U.S. Pat. No. 3,538,704 shows several devices such as blunt based cylinders and disks located in the center of the cavitating jet forming nozzle for the purpose of causing low pressure regions in the center of the jet and thus cavitation forming sites within this central region. This patent also shows vortex inducing vanes for producing a vortex in the central region of the jet and thus low pressure cavitation sites within the center of the jet. Any of the embodiments described herein for pulsing a cavitating jet may also include, in the jet forming nozzle, the addition of any of the central devices described in U.S. Pat. No. 3,352,704. Also, the methods and apparatus for artificially submerging jets described in U.S. Pat. Nos. 3,713,699 and 3,807,632 may be used to artificially submerge any of the nozzle embodiments described herein. Thus, it is intended that the present invention cover the modifications of this invention provided they come within the scope of the appended claims and their equivalents.

What is claimed is:

1. A method of eroding a solid surface utilizing at least two high velocity liquid jets supplied with liquid from a single plenum, comprising the steps of:

(a) forming at least one cavitating liquid jet containing vapor-filled cavities formed by directing a high velocity flow of said liquid through a first nozzle that reduces the local pressure surrounding the gas nuclei in said liquid below the vapor pressure of said liquid to form vapor-filled cavities therein;

(b) surrounding said cavitating liquid jet with a liquid medium contained in a chamber, wherein the solid surface comprises a portion of the boundary of said chamber;

(c) impinging said cavitating liquid jet against the solid surface at a point where substantially the maximum number of vapor-filled cavities collapse on the solid surface to thereby cause cavitational erosion of the solid surface;

(d) forming a high velocity pulsed liquid jet within said chamber by directing a high velocity flow of said liquid through a second nozzle and oscillating the velocity of the liquid jet exiting from said second nozzle at a frequency selected to provide a Strouhal number within the range of from about 0.2 to about 1.2, based on the diameter and velocity of said cavitating liquid jet; and (e) surrounding said pulsed liquid jet with said liquid medium contained in said chamber, said pulsed liquid jet being situated sufficiently close to said cavitating liquid jet such that the oscillation of the pulsed liquid jet within said chamber induces oscillation of the velocity of said cavitating liquid jet exiting from said first nozzle within said chamber, thereby enhancing the erosion of the solid surface by said cavitating liquid jet.

2. A method as claimed in claim 1, wherein said pulsed liquid jet exiting from said second nozzle is impinged against the solid surface to thereby cause additional erosion of the solid surface.

3. A method as claimed in claim 1, wherein a plurality of said high velocity cavitating liquid jets are formed by directing said liquid through a plurality of said first nozzles.

4. A method as claimed in claim 1, wherein said liquid medium contained in said chamber comprises spent liquid from said cavitating liquid jet and said pulsed liquid jet.

5. A method as claimed in claim 1, wherein the velocity of the pulsed liquid jet exiting from the second nozzle is oscillated mechanically.

6. A method as claimed in claim 1, wherein the velocity of the pulsed liquid jet exiting from the second nozzle is oscillated by hydrodynamic and acoustic interactions.

7. A method as claimed in claim 6, wherein said hydrodynamic and acoustic interactions are produced by an organ pipe oscillator, and wherein said second nozzle comprises the exit of said organ pipe oscillator.

8. A method as claimed in claim 6, wherein said hydrodynamic and acoustic interactions are produced by a Helmholtz oscillator.

9. Apparatus for producing at least two high velocity liquid jets for eroding a solid surface, comprising:

(a) plenum means for supplying a high velocity flow of liquid to the liquid jets;

(b) first nozzle means in fluid communication with said plenum means for forming at least one cavitating liquid jet containing vapor-filled cavities by reducing the local pressure surrounding the gas nuclei in said liquid below the vapor pressure of said liquid as a result of said liquid passing through said first nozzle means, said first nozzle means being situated so as to impinge said cavitating liquid jet against the solid surface to thereby cause cavitational erosion of the solid surface;

(c) a chamber containing a liquid medium for surrounding said cavitating liquid jet, wherein the solid surface comprises a portion of the boundary of said chamber; and (d) second nozzle means in fluid communication with said plenum means for forming a high velocity pulsed liquid jet within said chamber, said second nozzle means including means for oscillating the velocity of the liquid jet exiting therefrom at a frequency selected to provide a Strouhal number within the range of from about 0.2 to 1.2, based on the diameter and velocity of said cavitating liquid jet, said second nozzle means being situated sufficiently close to said first nozzle means such that the oscillation of the pulsed liquid jet within said chamber induces oscillation of the velocity of said cavitating liquid jet exiting from said first nozzle means within said chamber, thereby enhancing the erosion of the solid surface by said cavitating liquid jet.

10. Apparatus as claimed in claim 9, wherein said second nozzle means is situated so as to impinge said pulsed liquid jet against the solid surface to thereby cause additional erosion of the solid surface.

11. Apparatus as claimed in claim 9, wherein said first nozzle means includes means for forming a plurality of cavitating liquid jets.

12. Apparatus as claimed in claim 9, wherein said liquid medium in said chamber comprises spent liquid from said cavitating liquid jet and said pulsed liquid jet.

13. Apparatus as claimed in claim 9, wherein said means for oscillating the velocity of the pulsed liquid jet exiting from said second nozzle means comprises a mechanical oscillator.

14. Apparatus as claimed in claim 9, wherein said means for oscillating the velocity of the pulsed liquid jet exiting from said second nozzle means comprises a hydro-acoustic oscillator.

15. Apparatus as claimed in claim 14, wherein said hydro-acoustic oscillator comprises an organ pipe oscillator, the exit of said second nozzle means comprising the exit of said organ pipe oscillator.

16. Apparatus as claimed in claim 14, wherein said hydro-acoustic oscillator comprises a Helmholtz oscillator.

17. Apparatus as claimed in claim 9, further comprising a roller bit for mechanically eroding the solid surface, at least two extension arms in fluid communication with said plunum means for supplying drilling fluid to the solid surface, said drilling fluid comprising said liquid medium, wherein said first nozzle means includes means for forming at least two cavitating liquid jets situated at the respective extremities of said extension arms.

* * * * *